US007495373B2

(12) United States Patent
Sugahara

(10) Patent No.: US 7,495,373 B2
(45) Date of Patent: Feb. 24, 2009

(54) LIQUID TRANSPORTING APPARATUS AND METHOD OF PRODUCING LIQUID TRANSPORTING APPARATUS

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 507 days.

(21) Appl. No.: 11/391,491

(22) Filed: Mar. 29, 2006

(65) Prior Publication Data

US 2006/0232641 A1 Oct. 19, 2006

(30) Foreign Application Priority Data

Mar. 30, 2005 (JP) ..... 2005-099505

(51) Int. Cl.
*B41J 2/045* (2006.01)

(52) U.S. Cl. ..... 310/328; 310/324; 310/365; 347/68; 347/69; 347/70; 347/71; 347/72

(58) Field of Classification Search ..... 310/328, 310/363–366; 347/68–72
See application file for complete search history.

(56) References Cited

U.S. PATENT DOCUMENTS

| | | | | |
|---|---|---|---|---|
| 5,155,498 | A * | 10/1992 | Roy et al. | 347/11 |
| 5,767,612 | A | 6/1998 | Takeuchi et al. | |
| 2004/0223035 | A1 | 11/2004 | Hirota | |
| 2004/0263582 | A1* | 12/2004 | Sugahara | 347/68 |
| 2005/0068377 | A1* | 3/2005 | Ishikawa et al. | 347/68 |
| 2006/0066678 | A1* | 3/2006 | Rai et al. | 347/54 |
| 2007/0076054 | A1* | 4/2007 | Sugahara et al. | 347/47 |
| 2007/0085882 | A1* | 4/2007 | Chang | 347/70 |
| 2008/0036824 | A1* | 2/2008 | Ishikawa | 347/71 |

FOREIGN PATENT DOCUMENTS

| | | | |
|---|---|---|---|
| EP | 0718900 | A2 | 6/1996 |
| JP | 59118465 | A * | 7/1984 |
| JP | S63-246252 | A | 10/1988 |
| JP | 06015822 | A * | 1/1994 |
| JP | 2003025568 | A | 1/2003 |
| JP | 2004284109 | A | 10/2004 |

OTHER PUBLICATIONS

European Patent Office, European Search Report for Related Application No. EP 06006443, dated Jul. 5, 2007.

* cited by examiner

*Primary Examiner*—Jaydi SanMartin
(74) *Attorney, Agent, or Firm*—Baker Botts L.L.P.

(57) ABSTRACT

A piezoelectric actuator for a liquid transporting apparatus includes a drive plate having a base portion which is arranged, on an upper surface of a vibration plate covering a pressure chamber; outside of an end portion in a longitudinal direction of the pressure chamber, and a drive portion which extends from the base portion along the longitudinal direction at least up to an area facing a substantially central portion of the pressure chamber; and a piezoelectric layer arranged on the upper surface of the vibration plate. The drive plate is fixed to the vibration plate at the base portion and at the area facing the substantially central portion of the pressure chamber. By increasing an amount of deformation of the piezoelectric actuator, a liquid transporting apparatus with improved drive efficiency is provided.

17 Claims, 22 Drawing Sheets

LIQUID TRANSPORTING APPARATUS AND METHOD OF PRODUCING LIQUID TRANSPORTING APPARATUS

BACKGROUND OF THE INVENTION

1. Field of the Invention

The present invention relates to a liquid transporting apparatus which transports a liquid, and a method of producing the liquid transporting apparatus.

2. Description of the Related Art

An ink-jet head which includes a piezoelectric actuator which applies pressure to ink by utilizing deformation of a piezoelectric material when an electric field acts in the piezoelectric material is an example of an ink-jet head which discharges ink onto a recording medium such as recording paper. For example, an ink-jet head described in FIG. 9 of U.S. Patent Application Publication No. US2004/0223035 A1 (corresponding to FIG. 9 of Japanese Patent Application Laid-open No. 2004-284109) includes a channel unit having a plurality of pressure chambers each of which has a plane shape of a rhomboid which is long in one direction and which are arranged along a plane; and a piezoelectric actuator which is arranged on one surface of the channel unit. Further, the piezoelectric actuator includes a plurality of stacked piezoelectric sheets fixed to partition walls partitioning the pressure chambers such that the piezoelectric sheets cover the pressure chambers; a plurality of individual electrodes each of which is arranged, on a surface of the uppermost piezoelectric sheet, facing a central portion of one of the pressure chambers; and a plurality of common electrodes each of which sandwich the uppermost piezoelectric sheet which becomes an active layer, between the common electrodes and these individual electrodes respectively.

When a drive voltage is applied to a certain individual electrode of the individual electrodes to generate an electric field acting in a portion of the piezoelectric sheet sandwiched between this individual electrode and a common electrode of the common electrodes corresponding to this individual electrode, the electric field being in a direction of thickness which is a polarization direction of the piezoelectric sheets, the portion of the piezoelectric sheet are extended in the direction of thickness and contracted in a direction parallel to a plane of the piezoelectric sheet, which in turn bends the stacked piezoelectric sheets. Accordingly, a volume of the pressure chamber corresponding to this individual electrode is changed, and a pressure is applied to ink in the pressure chamber.

SUMMARY OF THE INVENTION

However, in the ink-jet head described in U.S. Patent Application Publication No. US 2004/0223035 A1, the piezoelectric sheets are fixed to the partition walls around the pressure chambers, and deformation of the piezoelectric sheets is constrained over an entire circumference of each of the pressure chambers. Further, since each of the individual electrodes is arranged on a surface of the uppermost piezoelectric sheet at a position which faces the central portion of each of the pressure chambers, a distance is short between a portion around the pressure chamber, the portion being fixed to the partition wall (in particular, a portion outside of the pressure chamber in a width direction of the pressure chamber), and a portion which overlaps with the central portion of each of the pressure chambers, in which each of the individual electrode is formed and which is deformed in a thickness direction of the piezoelectric sheet. Therefore, a bending amount of the piezoelectric sheets as a whole is small when the piezoelectric sheet directly below the individual electrode is contracted in a direction parallel to the plane of the piezoelectric sheet. Accordingly, for increasing the bending of the piezoelectric sheets to apply substantial pressure on ink in the pressure chamber, higher drive voltage is required, and a drive efficiency of the piezoelectric actuator is thus lowered.

An object of the present invention is to improve the drive efficiency by increasing the deformation amount of the piezoelectric actuator.

According to a first aspect of the present invention, there is provided a liquid transporting apparatus including:

a channel unit in which a liquid channel including a pressure chamber which is long in one direction is formed; and a piezoelectric actuator which applies pressure to a liquid in the pressure chamber by changing a volume of the pressure chamber, wherein:

the channel unit includes a vibration plate which covers the pressure chamber; and the piezoelectric actuator includes:

a drive plate which has a base portion which is arranged, on a side of the vibration plate opposite to the pressure chamber, outside of an end portion in a longitudinal direction of the pressure chamber; and a drive portion which extends from the base portion along the longitudinal direction at least up to an area facing a substantially central portion of the pressure chamber, the drive plate being fixed to the vibration plate at the base portion and at a portion of the drive portion facing the substantially central portion of the pressure chamber;

a piezoelectric layer arranged along a plane direction of the drive plate;

a first electrode which is arranged at an area on one surface side of the piezoelectric layer, the area facing the pressure chamber; and a second electrode which is arranged on the other surface side of the piezoelectric layer, wherein:

openings are formed in the drive plate, on both sides respectively of the drive portion, the both sides being in a short direction orthogonal to the longitudinal direction of the drive portion, each of the openings extending from the base portion along the longitudinal direction at least up to the area facing the substantially central portion of the pressure chamber, and the both sides of the drive portion in the short direction are defined by the openings; and the drive portion of the drive plate is separated from the vibration plate at a portion of the vibration plate overlapping in a plan view with the pressure chamber.

When a drive voltage is applied to the first electrode facing the pressure chamber, and the electric field in the thickness direction is acted in the portion of the piezoelectric layer sandwiched between the first electrode and the second electrode, this portion of the piezoelectric layer is deformed, and the drive portion is bent. Here, the drive plate on which the piezoelectric layer is arranged has the base portion which is arranged farther outside of the end portion in the longitudinal direction of the pressure chamber, and the drive portion which extends from the base portion along the longitudinal direction up to the substantially central portion of the pressure chamber, and the drive plate is fixed to the vibration plate both at the base portion and at a portion of the drive portion facing the substantially central portion of the pressure chamber. For example, the drive portion may be fixed only at an end portion on a side of the base portion and at the portion facing the substantially central portion of the pressure chamber, and may not be constrained at another portion other than the end portion toward the base portion and the portion facing the substantially central portion of the pressure chamber. In this case, when the piezoelectric layer is deformed when the electric field in the thickness direction acts on the piezoelectric layer, the drive portion on which the piezoelectric layer is arranged is bent to be curved or warped with the base portion as a base point, and the drive portion raises or lifts up (or presses down) a portion of the vibration plate facing the substantially central portion of the pressure chamber. Due to the lifting (or pressing), the volume of the pressure chamber is changed substantially and the pressure is applied to the ink inside the pressure chamber.

In this case, the drive plate is fixed to the vibration plate at two points, namely the base portion and the portion of the drive portion facing the substantially central portion of the pressure chamber, with respect to the longitudinal direction of the pressure chamber. In other words, these two fixing points are arranged separately by a comparatively long distance which is equal to or greater than half of a length of the pressure chamber in the longitudinal direction. Therefore, when the drive portion is bent to be curved with the base portion as the base point, a displacement amount of the portion fixed to the vibration plate (amount by which the vibration plate is lifted up (or pressed down)) is further increased. Therefore, according to the structure of the present invention, since it is possible to increase a deformation amount of the vibration plate at a comparatively low drive voltage, a drive efficiency of the piezoelectric actuator is increased. Further, the drive portion of the drive plate bends easily owing to the openings formed on both sides in the short direction respectively of the pressure chamber. Since a surface of the drive portion on the side of the vibration plate is not entirely fixed to the vibration plate along its surface, and has an area which is separated from the vibration plate (namely, the drive portion is partially separated from the vibration plate), the drive portion bends more easily. In the present invention, since a function of sealing the liquid by covering the pressure chamber and a function of propagating the deformation of the piezoelectric layer to the pressure chamber are realized by separate members, a degree of freedom of designing is higher as compared to a case in which these two functions are realized by one member. Further, the present invention includes not only an aspect in which the drive plate and the second electrode are formed by separate members, but also an aspect in which the drive plate is electroconductive and a surface of the drive plate on a side opposite to the pressure chamber also serves as the second electrode.

In the liquid transporting apparatus of the present invention, the piezoelectric layer may be arranged on the drive plate on the side opposite to the pressure chamber. In this structure, it is comparatively easy to form the piezoelectric layer on the drive plate.

In the liquid transporting apparatus of the present invention, the first electrode and a wiring portion connected to the first electrode may be formed on a surface of the piezoelectric layer on a side opposite to the pressure chamber. In this structure, the first electrode to which the drive voltage is applied, and the wiring portion for the first electrode can be formed comparatively easily.

In the liquid transporting apparatus of the present invention, the first electrode and a wiring portion connected to the first electrode may be formed on the surface of the drive plate on the side opposite to the pressure chamber. In this structure, since it is possible to draw the wiring portion in one direction on the surface of the drive plate on the side opposite to the pressure chamber, a structure of electric connections between the first electrode and a driving circuit for applying the drive voltage to the first electrode can be simplified. Further, by arranging also the driving circuit on the surface of the drive plate on the side opposite to the pressure chamber, it is possible to connect the first electrode and the driving circuit without using a wiring member such as an FPC (flexible printed circuit).

In the liquid transporting apparatus of the present invention, a plate thickness of a portion of the vibration plate facing the substantially central portion of the pressure chamber may be greater than a plate thickness of a portion of the vibration plate facing a peripheral portion of the pressure chamber. According to this structure, when the vibration plate is raised up (or pressed down) by the drive portion, the entire portion having a great plate thickness and facing the substantially central portion of the pressure chamber is displaced at one time. Accordingly, a change in the volume of the pressure chamber is further increased. Further, since a stiffness of the vibration plate in the area facing the peripheral portion of the pressure chamber is decreased as compared to a stiffness of the area facing the substantially central portion of the pressure chamber, the vibration plate is easily bent. Therefore, it is possible to apply high pressure to the liquid in the pressure chamber at a lower drive voltage, thereby further improving the drive efficiency of the piezoelectric actuator.

In the liquid transporting apparatus of the present invention, the drive portion may extend up to the area facing the substantially central portion of the pressure chamber, and may be fixed to the vibration plate at a tip end portion of the drive portion. In this structure, the drive portion is supported at its end portion on a side of the base portion, and raises up (or presses down) the vibration plate at its tip end portion (end portion on a side opposite to the base portion).

In the liquid transporting apparatus of the present invention, the drive portion may extend from one end side up to other end side in the longitudinal direction of the pressure chamber, the other end side being disposed farther from or beyond a center of gravity of the pressure chamber. Since a length of the drive portion extending toward the area facing the pressure chamber becomes further longer and a distance between the two fixing points at which the drive plate and the vibration plate are fixed is further increased, the deformation amount of the vibration plate lifted up (or pressed down) by the drive portion is increased markedly.

In the liquid transporting apparatus of the present invention, the drive portion may extend from one end portion in the longitudinal direction of the pressure chamber to other end portion in the longitudinal direction of the pressure chamber, so as to straddle over the pressure chamber; and the drive portion may be fixed to the vibration plate at a portion facing the substantially central portion of the pressure chamber. In this structure, the drive portion is supported at its both sides by its end portions on the both ends in the longitudinal direction, and lifts up (or presses down) the vibration plate at a midway portion facing the substantially central portion of the pressure chamber.

In the liquid transporting apparatus of the present invention, the first electrode may be formed only in an area on one surface side of the piezoelectric layer, the area facing the pressure chamber, the area being other than another area on the one surface side corresponding to the portion of the drive plate which is fixed to the vibration plate. In this structure, it is possible to realize a so-called pulling ejection in which when the drive voltage is applied to the first electrode, the volume inside to the pressure chamber is increased, and then the application of drive voltage is stopped to decrease the volume of the pressure chamber, thereby applying pressure to the liquid in the pressure chamber.

In the liquid transporting apparatus of the present invention, the first electrode may be formed in an area on one surface side of the piezoelectric layer, the area facing the pressure chamber, the area including another area on the one surface side corresponding to the portion of the drive plate which is fixed to the vibration plate. In this structure, it is possible to realize a so-called pushing ejection in which when the drive voltage is applied to the first electrode, the volume inside the pressure chamber is increased, thereby applying pressure to the liquid in the pressure chamber.

In the liquid transporting apparatus of the present invention, the both sides in the short direction of the drive portion may not be fixed to the vibration plate. For example, when the drive portion having a rectangular shape is fixed to the vibration plate at the four sides of the rectangular shaped drive portion, the maximum deformation amount of the drive plate is restricted by the length in the short direction of the drive plate. However, in the present invention, since the both sides in the short direction of the drive portion are not fixed to the vibration plate, the maximum deformation amount of the drive plate is not restricted due to the length in the short direction of the drive plate, and the deformation in the longitudinal direction can be utilized effectively.

In the liquid transporting apparatus of the present invention, the piezoelectric actuator may have areas in which the piezoelectric layer is not formed or is partially absent, the areas corresponding to the openings respectively. Since the piezoelectric layer is not formed in areas corresponding to the openings respectively, the deformation of the drive portion of the piezoelectric actuator is not hindered by the piezoelectric layer, thereby further improving the drive efficiency of the piezoelectric actuator.

In the liquid transporting apparatus of the present invention, the pressure chamber may have a plurality of chambers which are long in one direction; and the piezoelectric actuator may be formed as a plurality of piezoelectric actuators which are provided, corresponding to the chambers respectively, at portions on the surface of the vibration plate on the side opposite to the chambers, the portion substantially overlapping in a plan view with the chambers respectively. In this case, since the piezoelectric actuator is provided for each of the chambers, it is possible to transport a large amount of liquid by driving the plurality of chambers simultaneously.

In the liquid transporting apparatus of the present invention, a drive portion of a piezoelectric actuator included in the piezoelectric actuators and corresponding to one of two chambers included in the chambers, and a drive portion of another piezoelectric actuator corresponding to the other of the two chambers may be separated by the openings, the two chambers being adjacent to each other in the short direction which is orthogonal to the longitudinal direction of the chambers. In this case, since the chambers are arranged separated from each other in the short direction of the chambers by the openings, it is possible to suppress an occurrence of a cross-talk due to driving of the piezoelectric actuators of the respective chambers.

In the liquid transporting apparatus of the present invention, a portion of the drive portion not fixed to the vibration plate may be separated from the vibration plate while defining a gap between the portion and the vibration plate. In this structure, since the portion of the drive portion which is not fixed to the vibration plate does not come in contact with the vibration plate and the deformation is not hindered by the vibration plate. Therefore, the drive efficiency of the piezoelectric actuator is further improved.

According to a second aspect of the present invention, there is provided a method of producing a liquid transporting apparatus including a piezoelectric actuator which is arranged on one surface of a vibration plate of a channel unit in which a liquid channel including a plurality of pressure chambers is formed, the vibration plate covering pressure chambers, and which applies pressure to a liquid in the pressure chambers, the method including:

a step of providing a drive plate substrate which forms a drive plate;

a drive plate forming step of forming, in the drive plate substrate, a base portion which is located in an area outside of the pressure chambers when the drive plate substrate is arranged on the one surface of the vibration plate; a plurality of drive portions each of which extends from the base portion to an area facing one of the pressure chambers when the drive plate substrate is arranged on the one surface of the vibration plate; and openings each of which separates a drive portion included in the drive portions from another drive portion adjacent to the drive portion, the openings being formed on both sides of each of the drive portions, the both sides being in a direction orthogonal to a direction in which the drive portions extend; and a piezoelectric layer forming step of forming a piezoelectric layer by depositing particles of a piezoelectric material on one surface of the drive plate substrate.

Generally, when the pressure chambers are arranged densely (with high density) in order to reduce a size of the liquid transporting apparatus, it is necessary to arrange a plurality of piezoelectric elements at narrow intervals corresponding to the pressure chambers. However, there is a limitation on forming minutely the piezoelectric elements by a method of dividing by a dicer or the like. Further, there is a fear that a crack develops in the piezoelectric element when performing a forming process by dividing. In the present invention, however, the piezoelectric layer is formed by a method of depositing particles of a piezoelectric material on one surface of the drive plate after forming the drive plate which has the base portion, and the drive portions extending from the base portion. Therefore, even in a case of the interval is narrow between the drive portions, it is easy to form a piezoelectric layer on the surface of each of the drive portions. Moreover, no crack is developed in the piezoelectric layer.

In the method of producing the liquid transporting apparatus of the present invention, in the piezoelectric layer forming step, the piezoelectric layer may be formed by an aerosol deposition method, a sputtering method, or a chemical vapor deposition method. In this case, it is possible to easily form a piezoelectric layer of a desired thickness on the surface of the drive plate.

BRIEF DESCRIPTION OF THE DRAWINGS

FIG. 8 (FIGS. 8A to 8C) is a diagram showing a producing process of a piezoelectric actuator, wherein

FIG. 9 (FIGS. 9A and 9B) is a diagram explaining the piezoelectric layer forming step, wherein

FIG. 15 (FIGS. 15A and 15B) is a diagram explaining a piezoelectric layer forming step of fourth modified embodiment, wherein

DETAILED DESCRIPTION OF THE PREFERRED EMBODIMENTS

Figure 1:
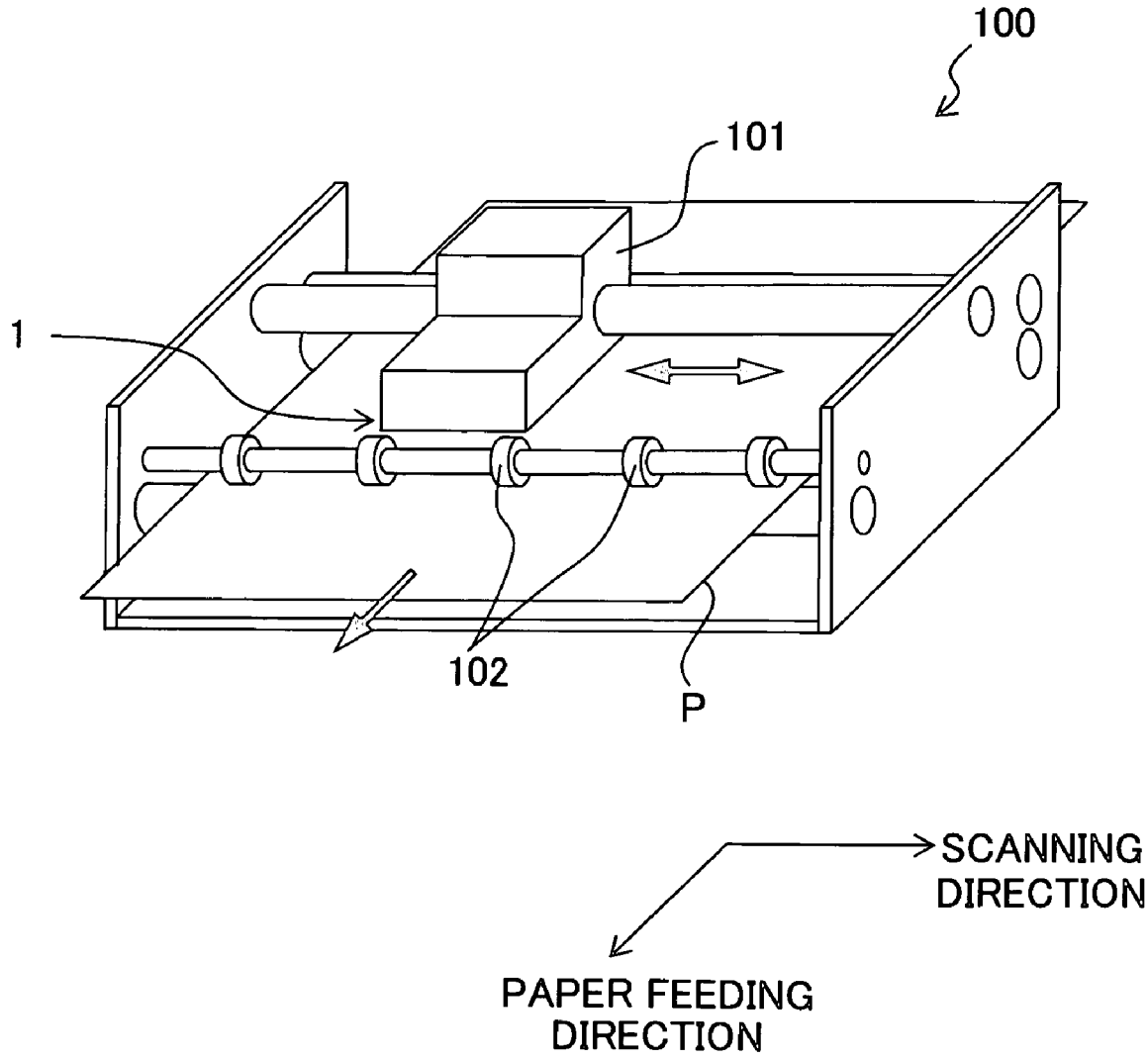
FIG. 1 is a schematic structural diagram of an ink-jet printer according to an embodiment of the present invention.

An embodiment of the present invention will be explained below. The embodiment is an example in which the present invention is applied to an ink-jet head which discharges ink from nozzles onto a recording paper, as a liquid transporting apparatus. Firstly, an ink-jet printer 100 which includes an ink-jet head 1 will be explained briefly. As shown in FIG. 1, the ink-jet printer 100 includes a carriage 101 which is movable in a scanning direction in FIG. 1, an ink-jet head 1 of a serial type which is provided on the carriage 101 and jets ink onto a recording paper P, and transporting rollers 102 which feed the recording paper P in a paper feeding direction in FIG. 1. The ink-jet head 1 moves integrally with the carriage 101, in the scanning direction (left and right direction) and jets ink onto the recording paper P from ejecting ports of nozzles 20 (see FIG. 4) formed in an ink-discharge surface of the ink-jet head 1. The recording paper P with an image and/or a letter recorded thereon by the ink-jet head 1 is discharged in the paper feeding direction (forward direction) by the transporting rollers 102.

Next, the ink-jet head 1 will be explained in detail with reference to FIG. 2 to FIG. 5. As shown in FIG. 2 to FIG. 5, the ink-jet head 1 includes a channel unit 2 in which an ink channel is formed, and a piezoelectric actuator 3 which is arranged on an upper side of the channel unit 2.

Figure 4:
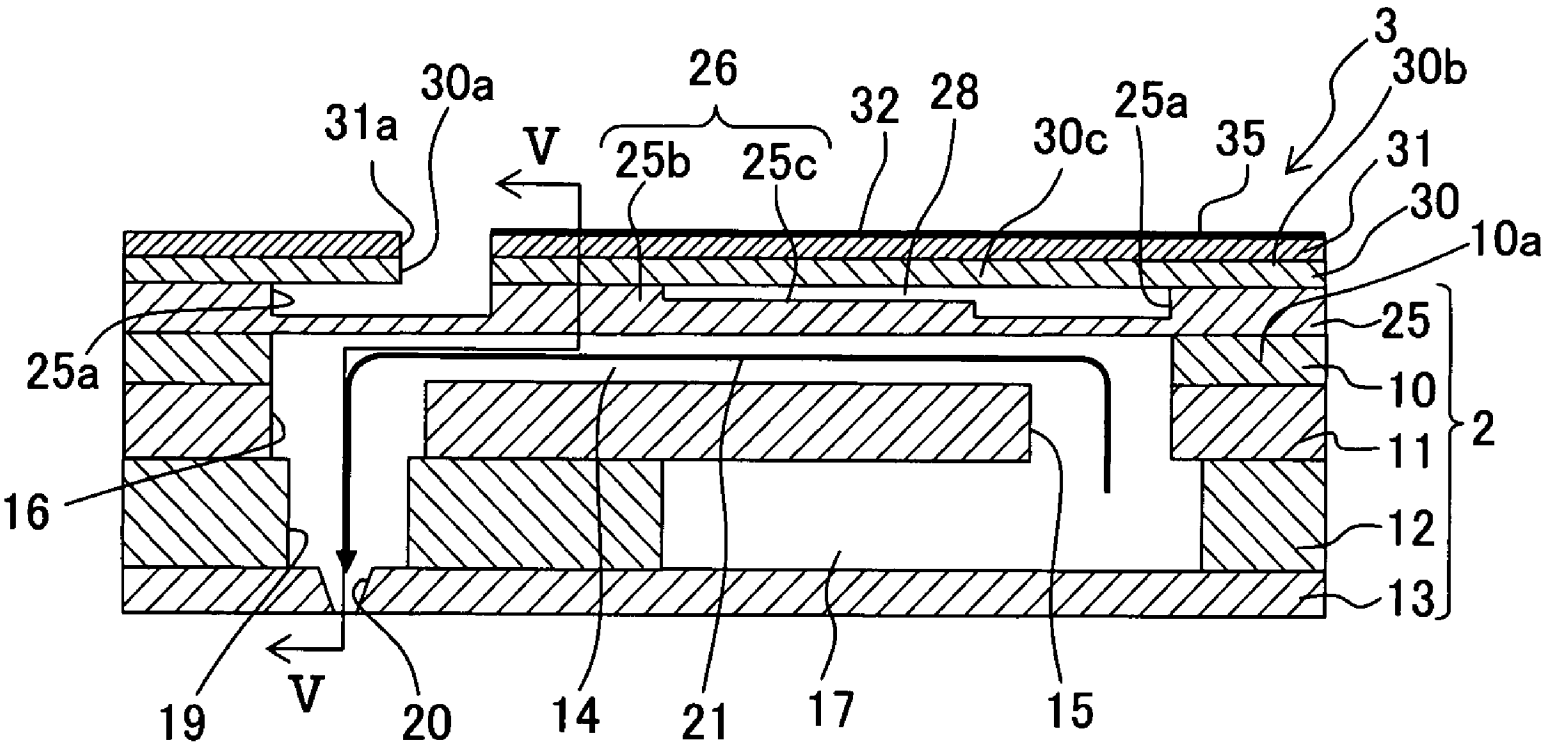
FIG. 4 is a cross-sectional view taken along a line IVA-IVA shown in FIG. 2.
Figure 5:
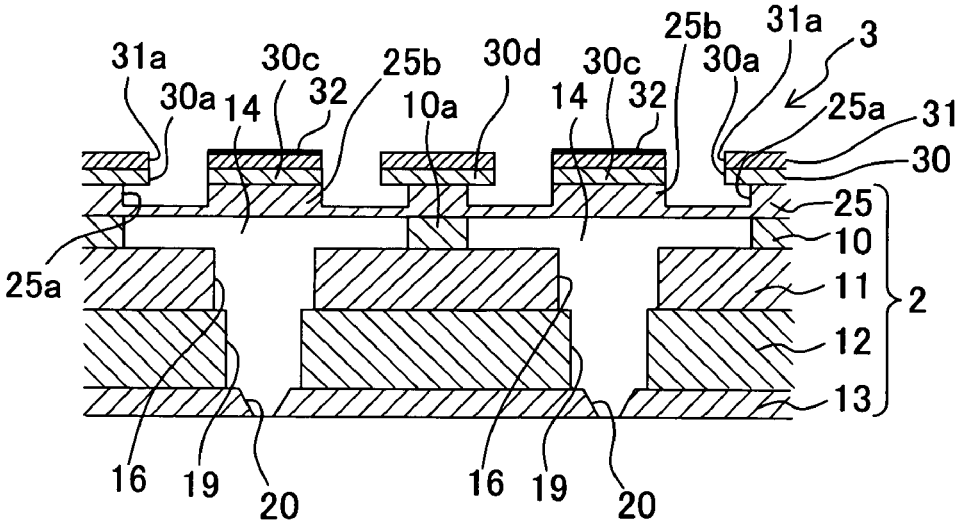
FIG. 5 is a cross-sectional view taken along a line VB-VB shown in FIG. 4.

The channel unit 2 will be explained below. As shown in FIG. 4 and FIG. 5, the channel unit 2 includes a cavity plate 10 in which ink channels are formed, a base plate 11, a manifold plate 12, a nozzle plate 13, and a vibration plate 25, and these five plates are joined in stacked layers.

The four plates, namely the cavity plate 10, the base plate 11, the manifold plate 12, and the nozzle plate 13 will be explained. Among these four plates 10 to 13, since the cavity plate 10, the base plate 11, and the manifold plate 12 are stainless steel plates, ink channels such as a manifold 17 and a pressure chamber 14 which will be explained later, can be formed easily by etching in these three plates. The nozzle plate 13 is formed of a high-molecular synthetic resin material such as polyimide, and is joined to a lower surface of the manifold plate 12. Alternatively, the nozzle plate 13 also may be formed of a metallic material such as stainless steel similar to the three plates 10 to 12.

As shown in FIG. 2 to FIG. 5, in the cavity plate 10, partition walls 10*a* are defined by forming a plurality of pressure chambers 14 arranged along a plane. In other words, the pressure chambers 14 formed in the cavity plate 10 are mutually separated by the partition walls 10*a*. Further, the pressure chambers 14 are open upwardly, and are arranged in two rows in the paper feeding direction (up and down direction in FIG. 2). Each of the pressure chambers 14 is formed to be substantially elliptical in a plan view and is arranged so as to be long in the scanning direction (left and right direction in FIG. 2).

Communicating holes 15 and 16 are formed in the base plate 11 at positions which overlap in a plan view with both end portions respectively, in the longitudinal direction of the associated pressure chamber 14. In the manifold plate 12, a manifold 17 is formed. The manifold 17 extends in two rows in the paper feeding direction (up and down direction in FIG. 2) which is a direction in which the pressure chambers 14 are arranged, and overlaps with an end portion of each of the pressure chamber 14 on a side of the communicating hole 15. Ink is supplied to the manifold 17 from an ink tank (omitted in the diagram) via an ink-supply port 18 formed in the vibration plate 25. Further, communicating holes 19 are formed at positions each of which overlaps in a plan view with an end portion of one of the pressure chambers 14, the end portion being on a side opposite to the manifold 17. Furthermore, nozzles 20 are formed in the nozzle plate 13 at positions overlapping in a plan view with the communicating holes 19 respectively. The nozzles 20 are formed, for example, by subjecting a substrate of a high-molecular synthetic resin such as polyimide to an excimer laser processing.

As shown in FIG. 4, the manifold 17 communicates with the pressure chamber 14 via the communicating hole 15 and the pressure chamber communicates with the nozzle 20 via the communicating holes 16 and 19. Thus, individual ink channels 21 each from the manifold 17 to one of the nozzles 20 via one of the pressure chambers 14 are formed in the channel unit 2.

Next, the vibration plate 25 will be explained below. The vibration plate 25 is made of a metallic material such as an iron alloy like stainless steel, a copper alloy, a nickel alloy, and a titanium alloy, a material such as silicon and glass, a ceramics material such as alumina and zirconia, or a synthetic resin material like polyimide. The vibration plate 25 is joined to the upper surfaces of the partition walls 10*a* of the cavity plate 10, and covers the pressure chambers 14 which are open upwardly.

As shown in FIG. 4 and FIG. 5, an annular groove 25*a* extending in a plan view along an edge of each of the pressure chambers 14 is formed on the upper surface of the vibration plate 25, in an area overlapping in a plan view with a peripheral portion which is inside of the edge of each of the pressure chambers 14. Further, a portion of the vibration plate 25 overlapping in a plan view with a substantially central portion of each of the pressure chambers 14 has a substantially elliptical plane shape (elliptical portion 26). A plate thickness of the elliptical portion 26 of the vibration plate 25 is greater than a plate thickness of a portion of the vibration plate 25 in which the annular groove 25*a* is formed, namely the portion overlapping in the plan view with the peripheral portion of the pressure chamber 14. Furthermore, a joining portion 25*b* having a circular plane shape is formed at one end portion in a longitudinal direction (left end portion in FIG. 3 and FIG. 4) of the elliptical portion 26, and is joined to a drive plate 30 of the piezoelectric actuator 3 which will be described later. The joining portion 25*b* is arranged at a position shifted to one side (left side in FIG. 3 and FIG. 4) from a position of center of gravity G of the portion of the vibration plate 25 overlapping in a plan view with each of the pressure chambers 14. A portion of the elliptical portion 26 of the vibration plate 25, which is other than the joining portion 25*b*, forms a flat portion 25*c*. The flat portion 25*c* is formed to be thinner than the joining portion 25*b* and to be thicker than the annular groove 25*a*.

Next, the piezoelectric actuator 3 will be explained below. The piezoelectric actuator 3 includes a drive plate 30 which is arranged on the upper surface (surface on a side opposite to the pressure chamber 14) of the vibration plate 25, a piezoelectric layer 31 which is arranged on the upper surface of the drive plate 30, and individual electrodes 32 (first electrodes) formed on the upper surface of the piezoelectric layer 31 corresponding to the pressure chambers 14 respectively.

The drive plate 30 is made of a metallic material such as an iron alloy like stainless steel, a copper alloy, a nickel alloy, a chromium alloy, an aluminum alloy, or a titanium alloy. As shown in FIG. 2 to FIG. 6, slits 30*a* in a through form are formed in the drive plate 30 in areas each of which overlapping in a plan view with the peripheral portion of one of the pressure chambers 14. Each of the slits 30*a* surrounds substantially a circumference of the elliptical portion 26 in a plan view, and is formed in a shape of English alphabet "U" in a plan view and has a turn-round (bend) on a side of the joining portion 25*b*. In other words, each of the slits 30*a* is formed such that the slit 30*a* is extended from one end along the longitudinal direction of the pressure chamber, then turned the direction through 180° to return in a half circle form, and once again extends up to the other end along the longitudinal direction of the pressure chamber 14. Two end portions of the slit 30*a* are arranged substantially in a line in a short direction of the pressure chamber 14. The vibration plate 30 includes a base portion 30*b* which is an area on a side opposite to the turn-round portion (bent portion) of each of the slits 30*a* and disposed farther from the two end portions of each of the slits 30*a*, and which overlaps with a portion disposed in further outside in the longitudinal direction of the pressure chambers 14, from end portions of the pressure chambers 14 on a side of the communicating hole 15 (right end portion in FIG. 3 and FIG. 4), and the vibration plate 30 includes a plurality of drive portions 30*c* each of which is formed inside of one of the slits 30*a*, and each of which extends from the base portion 30*b* along the longitudinal direction of one of the pressure chambers 14.

Figure 2:
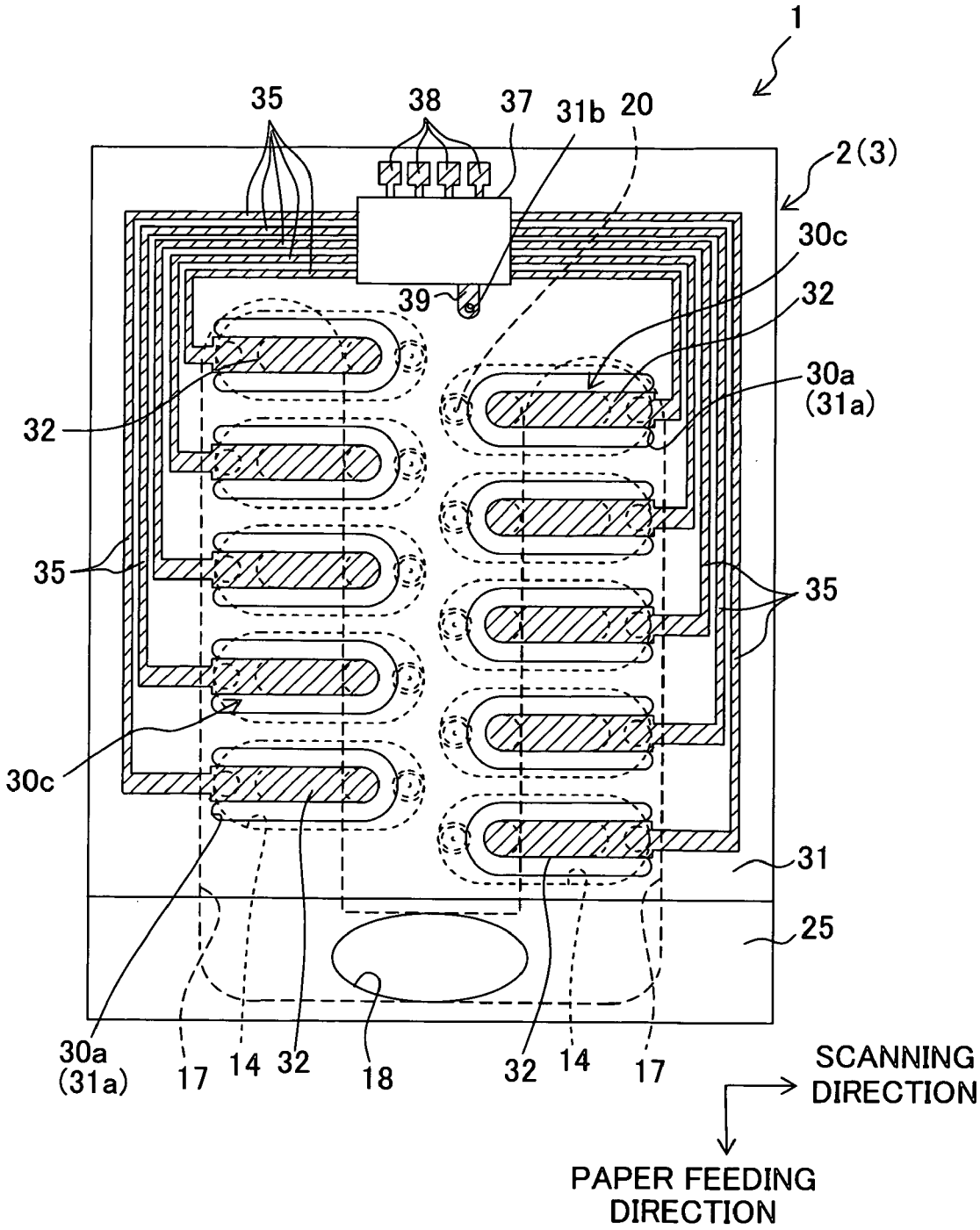
FIG. 2 is a plan view of an ink-jet head.
Figure 3:
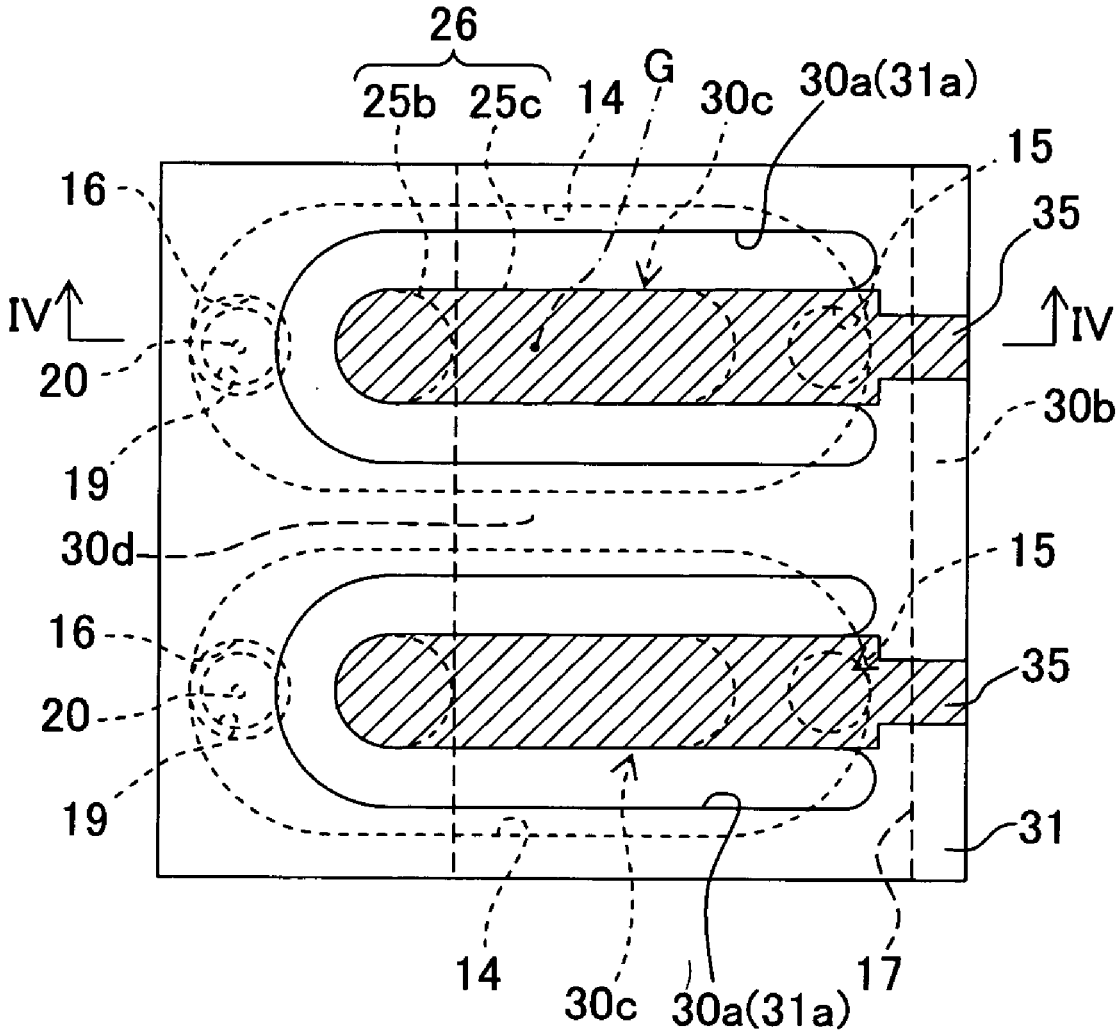
FIG. 3 is a partially enlarged view of FIG. 2.

On the outside of rows of the pressure chambers 14 arranged in two rows shown in FIG. 2 (both left and right sides in FIG. 2), the base portion 30*b* is formed as two base portions 30*b* corresponding to the two rows of the pressure chambers 14 respectively, and extending in the paper feeding direction (up and down direction in FIG. 2), and these two base portions 30*b* are connected mutually by a connecting portion 30*d* positioned on the outside of the slits 30*a*. The plurality of drive portions 30*c* are isolated (separated), by the U-shaped slits 30*a* corresponding to the pressure chambers 14, from the surrounding except for at an end portion on the side of the base portion 30*b* of each of the drive portions 30*a*. Further, each of the drive portions 30*c* extends from the base portion 30*b* along the longitudinal direction of one of the pressure chambers 14 up to an area facing the substantially central portion of one of the pressure chambers 14. Furthermore, as shown in FIG. 3, a tip end portion of each of the drive portions 30*c* is reached up to a position on a side opposite to the base portion 30*b*, farther from or beyond the position of center of gravity G of the pressure chamber 14.

As shown in FIG. 4 and FIG. 5, the connecting portion 30*d* and the base portions 30*b* of the drive plate 30 are fixed to the upper surface of the vibration plate 25 by an adhesive. Further, the drive portions 30*c* are fixed to one of the joining portions 25*b* of the vibration plate 25 at the respective tip end portions by an adhesive. As mentioned earlier, each of the flat portions 25*c* of the vibration plate 25 adjacent to the joining portion 25*b* has a height smaller to some extent than a height of the joining portion 25*b*. Therefore, as shown in FIG. 4, there is a gap 28 between each of the drive portions 30*c* and each of the flat portions 25*c*. In other words, a portion of the drive portion 30*c* not joined to the vibration plate 25 is separated from the vibration plate 25 by the gap 28, and this portion of the drive portion 30*c* and the vibration plate 25 do not come in contact with each other. Furthermore, the height of the vibration plate 25 is even smaller in the annular groove 25*a* which surrounds the joining portion 25*b* and the flat portion 25*c*. Accordingly, the vibration plate 25 and the drive portion 30*c* do not make a contact also in a portion where the annular groove 25*a* is formed.

The drive plate 30 is electroconductive, and is always kept at a ground potential as will be explained later. The drive plate 30 also serves as a common electrode (second electrode) which makes an electric field act in the piezoelectric layer 31 sandwiched between the individual electrodes 32 and the drive plate 30.

The piezoelectric layer 31, mainly composed of lead zirconate titanate (PZT) which a solid solution of lead titanate and lead zirconate, and is a ferroelectric substance, is arranged on the upper surface of the drive plate 30, along a plane direction of the drive plate 30. As shown in FIG. 2 to FIG. 5, the piezoelectric layer 31 is formed continuously over the pressure chambers 14, on the upper surface of the drive plate 30. A plurality of through-slits 31*a* having the same U-shaped plane form as the slits 30*a* of the drive plate 30 are formed in the piezoelectric layer 31 at positions each of which corresponds to one of the slits 30*a*. In other words, portions of the piezoelectric layer 31 arranged in the drive portions 30*c* respectively are isolated or separated from the surrounding by the slits 31*a*.

On the upper surface of the piezoelectric layer 31, a plurality of individual electrodes 32 are formed in areas each of which faces one of the drive portions 30*c*. In other words, the individual electrodes 32 are formed at positions each of which overlaps in a plan view with the central portion of the corresponding pressure chamber 14. Further, as shown in FIG. 2, the individual electrodes 32 are arranged in two rows in the paper feeding direction (up and down direction in FIG. 2) corresponding to the pressure chambers 14 respectively. The individual electrodes 32 are made of an electroconductive material such as gold, copper, silver, palladium, platinum, or titanium. On the upper surface of the piezoelectric layer 31, a plurality of wiring portions 35 are formed. Each of the wiring portions 35 extends from an area facing an end portion (end portion on outer side in the width direction of the ink-jet head 1) of one of the individual electrodes 32, the end portion being on the side of the communicating hole 15.

Further, as shown in FIG. 2, a driver IC 37 is arranged in an area on a far side (upper side in FIG. 2) from the area facing the pressure chambers 14. The wiring portions 35, each extending to an upstream side of the paper feeding direction in FIG. 2, are connected to the driver IC 37 on the upper surface of the piezoelectric layer 31. Furthermore, a plurality of terminals 38 (four terminals, for example) connected to the driver IC 37 are formed on the upper surface of the piezoelectric layer 31, and via these terminals 38, the driver IC 37 and a control unit (omitted in the diagram) of the ink-jet printer 100 which controls the driver IC 37 are connected. Based on a command from the control unit, a drive voltage is selectively supplied from the driver IC 37 to the individual electrodes 32. When the driver IC 37 is arranged directly on the upper surface of the piezoelectric layer 31, there is a fear that the piezoelectric layer 31 directly below the driver IC 37 is deformed to affect an operation of the driver IC 37. Therefore, it is preferable that an insulating film is interposed at least between the upper surface of the piezoelectric layer 31 and the driver IC 37.

Further, as shown in FIG. 2, a through hole 31*b* is formed in the piezoelectric layer 31 at a position in the vicinity of the driver IC 37. The through hole 31*b* is reached up to the upper surface of the drive plate 30 which serves as the common electrode. An electroconductive material is filled in the through hole 31*b*, and brought into conduction with the drive plate 30. Furthermore, the electroconductive material is connected to the driver IC 37 via a wiring portion 39 formed on the upper surface of the piezoelectric layer 31. Therefore, the drive plate 30 is connected to the driver IC 37 via the electroconductive material in the through hole 31*b* and via the wiring portion 39, and the drive plate 30 is always kept at the ground potential via the drive IC 37.

The piezoelectric actuator 3 of the present invention is a so-called unimorph piezoelectric actuator, which includes the drive plate 30 made of a metal, and the piezoelectric layer 31 formed on the drive plate 30. Instead of this unimorph piezoelectric actuator 3, a so-called bimorph piezoelectric actuator which includes two piezoelectric layers and a metal layer sandwiched between the two piezoelectric layers can also be used. However, in a case of using the bimorph piezoelectric actuator, it is necessary to form two piezoelectric layers 31 on both surfaces of the drive plate 30 which is a metal layer, and to form the individual electrode 32 and the wiring portion 35 on a surface of each of the two piezoelectric layers 31, thereby complicating the producing process. As compared to the bimorph piezoelectric actuator, in the unimorph piezoelectric actuator 3 of the present invention, one piezoelectric layer 31 is formed on the upper surface (surface on a side opposite to the pressure chambers 14) of the drive plate 30, and the individual electrodes 32 and the wiring portions 35 are formed on the upper surface of the piezoelectric layer 31. Therefore, as compared to the above-described bimorph piezoelectric actuator 3, the piezoelectric layer 31, the individual electrodes 32, and the wiring portions 35 can be formed comparatively easily.

Next, an action of the piezoelectric actuator 3 at a time of an ink discharge operation will be explained below. When the drive voltage is applied selectively to the individual electrodes 32 from the driver IC 37, the electric potential of an individual electrode 32 of the individual electrodes 32 on the upper side of the piezoelectric layer 31 to which the drive voltage is supplied differs from the electric potential of the drive plate 30 which is on the lower side of the piezoelectric layer 31, which is kept at the ground potential and which serves as the common electrode, and an electric field is generated in a vertical direction (thickness direction) in a portion of the piezoelectric layer 31 sandwiched between the individual electrode 32 and the drive plate 30. At this time, when the direction in which the piezoelectric layer 31 is polarized and the direction of the electric field are same, the piezoelectric layer 31 is contracted in a horizontal direction orthogonal to the vertical direction in which the piezoelectric layer 31 is polarized.

Figure 7:
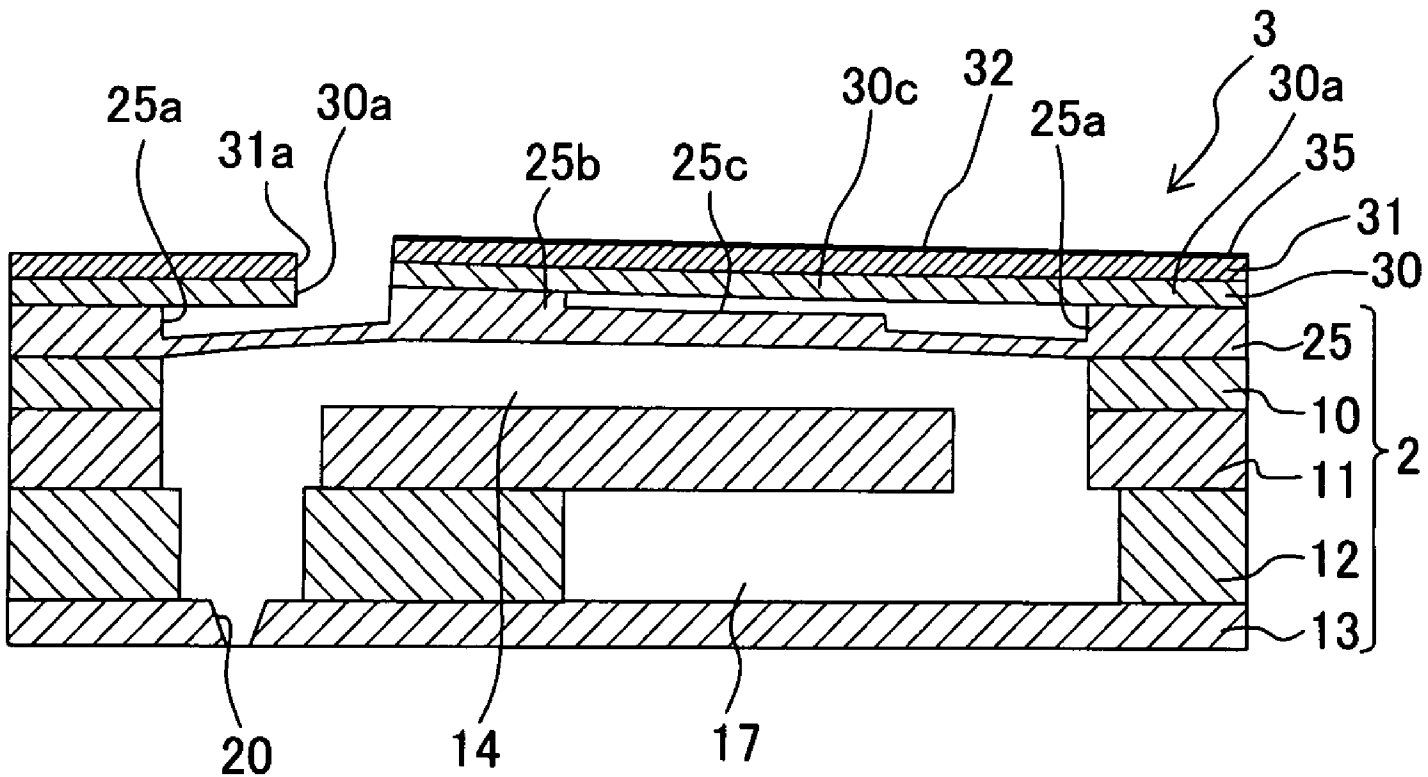
FIG. 7 is a partial cross-sectional view of the ink-jet head showing a state in which a drive voltage is applied to an individual electrode.

Here, as explained earlier, the drive plate 30 on which the piezoelectric layer 31 is arranged is fixed to the vibration plate 25 at the base portions 30*b* and the portions of the drive portions 30*c* each of which faces the substantially central portion of one of the pressure chambers 14. In other words, since each of the drive portions 30*c* is fixed to the vibration plate 25 only at the end portion on the side of the base portion 30*b* and the tip portion facing the substantially central portion of one of the pressure chambers 14, and is separated from the vibration plate 25 at its portion other than the end portion and tip portion, the deformation of the drive portion 30*c* is not constrained. Therefore, when the piezoelectric layer 31 on the upper surface of the drive portion 30*c* is extended in the thickness direction and contracted in the horizontal direction, as shown in FIG. 7, the drive portion 30*c* is bent such that the drive portion 30*c* is curved up with the base portion 30*b* as the base point of the curving, and consequently the drive portion 30*c* lifts up the joining portion 25*b* of the vibration plate 25 facing the substantially central portion of the pressure chamber 14, thereby increasing the volume inside the pressure chamber 14. Further, the annular groove 25*a* is formed on the upper surface of the vibration plate 25 in the area facing the peripheral portion of each of the pressure chambers 14, and the plate thickness of the portion of the vibration plate 25 facing the substantially central portion of the pressure chamber 14 is greater than the plate thickness of the portion of the vibration plate 25 and facing the peripheral portion of the pressure chamber 14. Therefore, when the vibration plate 25 is raised up by the drive portion 30*c*, the entire portion having a thick plate thickness and facing the substantially central portion of the pressure chamber 14 is raised up and the cross-sectional shape of the pressure chamber 14 is changed from the rectangular shape (see FIG. 4) to a substantially trapezoid shape (see FIG. 7), thereby substantially increasing the volume of the pressure chamber 14.

Afterwards, when the application of drive voltage to the individual electrode 32 is stopped, as shown in FIG. 4, the drive portion 30*c* which was raising the vibration plate 25 is returned to the horizontal state again, and the volume inside the pressure chamber 14 is decreased as compared to the volume when the driving voltage is applied. At this time, the pressure is applied to the ink in the pressure chamber 14, and droplets of ink are discharged from the nozzle 20 communicating with the pressure chamber 14.

Thus, the ink-jet head 1 of this embodiment is structured to discharge ink by performing a so-called pulling ejection in which the volume inside the pressure chamber 14 is increased once, then the volume of the pressure chamber 14 is decreased to apply the pressure to the ink in the pressure chamber 14.

According to the ink-jet head 1 and the piezoelectric actuator 3 of this embodiment, the drive plate 30 is fixed to the vibration plate 30 at the base portions 30*b* arranged on the outside of the end portions in the longitudinal direction of the pressure chambers 14, and at the tip end portions of the drive portion 30*c* each of which extends, from the base portion 30*b*, in the longitudinal direction of one of the pressure chambers 14, each of the tip portions facing the substantially central portion of one of the pressure chamber 14. Further, the tip end portion of each of the drive portions 30*c* is reached up to the position on a side opposite to the base portion 30*b*, the position being farther from or beyond the position of the center of gravity G (see FIG. 3) of one of the pressure chambers 14. With respect to the longitudinal direction of the pressure chamber 14, the two fixing points, at which the vibration plate 25 and the drive plate 30 are fixed with each other, are arranged at a substantially long distance which is not less than half the length of the pressure chamber 14 in the longitudinal direction. Therefore, the deformation amount of the vibration plate 25 (amount by which the vibration plate 25 is raised up) when the drive portion 30*c* is deformed to be curved up with the base portion 30*b* as the base point of curve becomes considerably great. Therefore, it is possible to substantially change (deform) the vibration plate 25 even at a comparatively low drive voltage, thereby improving the drive efficiency of the piezoelectric actuator 3.

Further, the plate thickness of the portions of the vibration plate 25 each facing the substantially central portion of one of the pressure chambers 14 is greater than the plate thickness of the portions of the vibration plate 25 each facing the peripheral portion of one of the pressure chambers 14. Accordingly, when the drive portion 30*c* is deformed to be curved up, the entire portion of the vibration plate 25 having a greater thickness and facing the substantially central portion of the pressure chamber 14 is consequently raised up. Therefore, the volume of the pressure chamber 14 is increased substantially. Furthermore, since the stiffness of the vibration plate 25 in the areas each facing the peripheral portion of one of the pressure chambers 14 is reduced as compared to the stiffness of the areas of the vibration plate 25 each facing the substantially central portion of one of the pressure chambers 14, the vibration plate 25 is easily deformed. Therefore, it is possible to apply substantial pressure to the ink in the pressure chamber 14 at further lower drive voltage, and the drive efficiency of the piezoelectric actuator 3 is further improved.

Furthermore, the portion of the drive portion 30*c* which is other than the tip end portion and the end portion on the side of the base portion 30*b*, and which is not fixed to the vibration plate 25 is separated from the vibration plate 25 by the gap 28. Therefore, the deformation of the portion of the drive portion 30*c* which is not fixed to the vibration plate 25 is not hindered by the vibration plate 25. Therefore, the drive efficiency of the piezoelectric actuator 3 is further improved.

Moreover, each of the drive portions 30*c* is isolated (separated) from the surrounding, except for at the end portion on the side of the base portion 30*b*, by one of the U-shaped slits 30*a*, and the piezoelectric layer 31 on the upper side of the drive portions 30*a* is also isolated (separated) from the surrounding by the slit 31. Therefore, when a certain drive portion 30*c* and the piezoelectric layer 31 on the surface of the certain drive portion 30*c* are deformed, a phenomenon (so-called cross-talk) in which the deformation of one drive portion 30*a* is propagated to another drive portion 30*c* is suppressed. Therefore, it is possible to suppress a variation in discharge characteristics of droplets jetted from the nozzles 20, and to improve the printing quality.

Figure 8A:
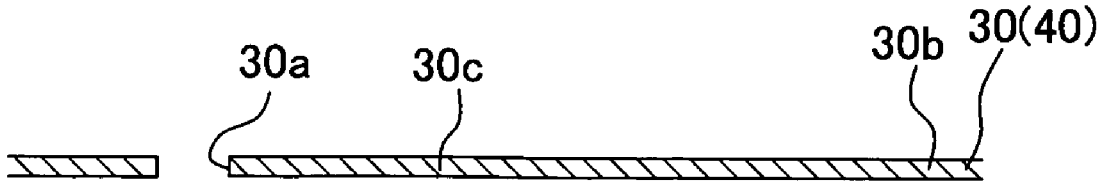
FIG. 8A shows a drive plate forming step.

Next, a method of producing the piezoelectric actuator 3 of this embodiment will be explained by referring to FIG. 8 and FIG. 9. Firstly, as shown in FIG. 8A, through-slits 30*a* are formed in a substrate 40 (which is to form the drive plate 30) in the form of a flat plate made of a metallic material such as an iron alloy like stainless steel, a copper alloy, a nickel alloy, a chromium alloy, an aluminum alloy, and a titanium alloy, by using a method such as the etching, a wire cut, an ultrasonic processing, an electric discharge processing, or a cutting processing, such that the slits 30*a* have a shape of English alphabet "U" and correspond to the pressure chambers 14 respectively. In other words, by forming the slits 30*a* in the drive plate 30, there are formed the connecting portions 30*d* between adjacent slits 30*a* (see FIG. 6); the base portions 30*b* disposed on the both sides respectively of the drive plate 30, the both side being in the longitudinal direction of the drive plate 30, and being opposite to the bent portions of the slits 30*a*, farther away from the end portion of one of the slits 30*a*; and the drive portions 30*c* each of which extends from one of the base portions 30*b* toward the bending portion of one of the slits 30*a*, and surrounded by the slits 30*a* (drive plate forming step).

Figure 8B:
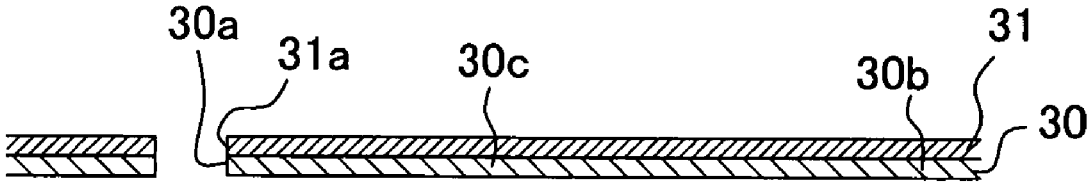
FIG. 8B shows a piezoelectric layer forming step.
Figure 9A:
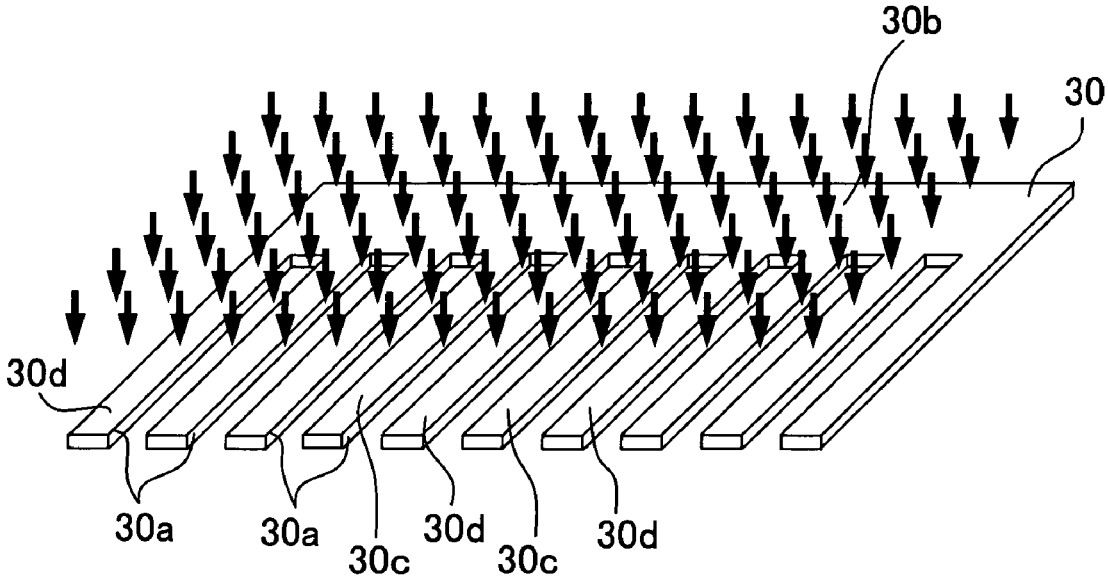
FIG. 9A shows a state in which particles of a piezoelectric material are being deposited on a surface of the drive plate.
Figure 9B:
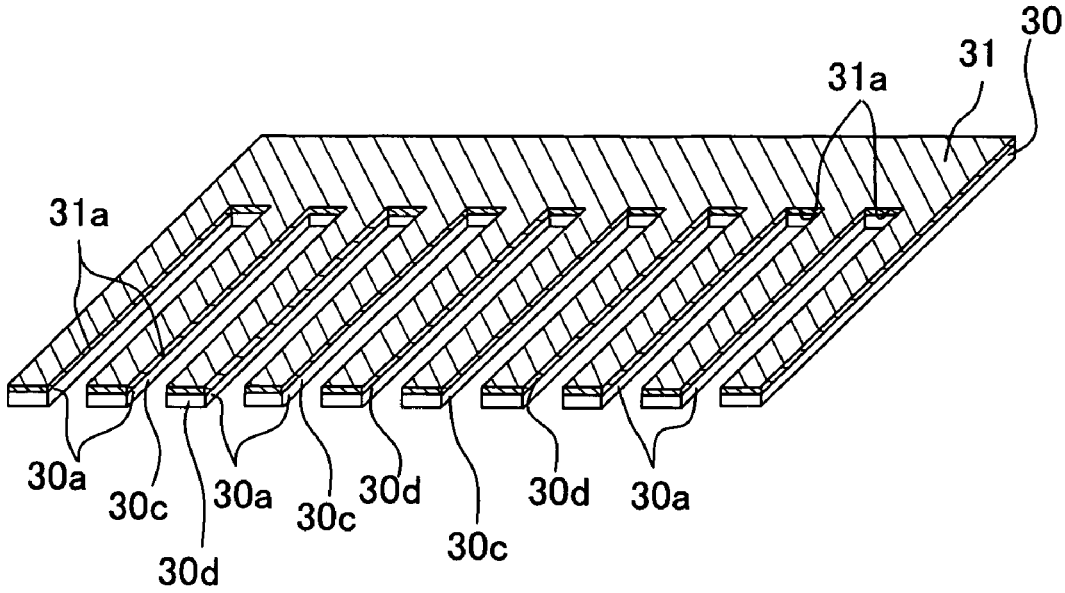
FIG. 9B shows the formed piezoelectric layer.

Next, as shown in FIG. 8B and FIG. 9A, the piezoelectric layer 31 is formed on one surface of the drive plate 30 by depositing particles of a piezoelectric material (piezoelectric layer forming step). Here, the piezoelectric layer 31 can be formed by the aerosol deposition method (AD method) in which very small particles of a piezoelectric material are deposited on a substrate by blowing the particles onto the substrate and making the particles collide on the substrate at a high speed. Alternatively, a sputtering method, a chemical vapor deposition method (CVD method), a sol-gel method, a solution coating method, or a hydrothermal synthesis method can also be used to form the piezoelectric layer 31. Here, when the particles of a piezoelectric material are deposited on the surface of the vibration plate 30 by the AD method, the sputtering method, or the CVD method, the particles of the piezoelectric material are not adhered to (not deposited on) an inner surface of each of the slits 30*a*. Therefore, as shown in FIG. 9B, simultaneously with the forming of the piezoelectric layer 31, it is possible to form, in the piezoelectric layer 31, slits 31*a* having a plane shape in the U-form same as the slits 30*a* in the drive plate 30, thereby simplifying the producing process.

Figure 8C:
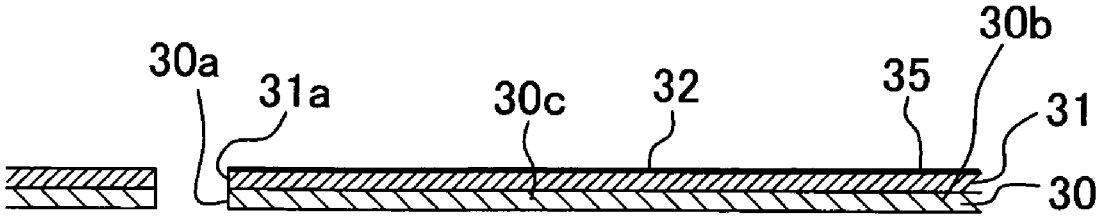
FIG. 8C shows an individual electrode forming step.

Finally, as shown in FIG. 8C, the individual electrodes 32 are formed on the surface of the piezoelectric layer 31 in the areas facing the drive portions 30*c* respectively, and the wiring portions 35 connected to the individual electrodes 32 respectively are formed. The individual electrodes 32 and the wiring portions 35 can be formed at one time by screen printing. Alternatively, after forming an electroconductive film on the entire surface of the piezoelectric layer 31, a pattern of the individual electrodes 32 and the wiring portions 35 may be formed by removing the electroconductive film in the unnecessary areas by laser beam processing.

According to the method of producing of the piezoelectric actuator 3, the slits 30*a* are formed in the flat-shaped substrate 40 so as to form drive plate 30 which includes the base portions 30*b* and the drive portions 30*c* each extending from the base portion 30*b*. Afterwards, the piezoelectric layer 31 is formed on one surface of the drive plate 30 by a method of depositing the particles of a piezoelectric material. Therefore, even when it is necessary to make the interval to be narrow between the drive portions 30*c* corresponding to the pressure chambers 14 for the purpose of arranging the pressure chambers 14 densely (with high density), the piezoelectric layer 31 can be easily formed on the respective surfaces of the drive portions 30*c*. Further, unlike a method of performing division by a dicer or the like, there is no fear of developing a crack in the piezoelectric layer 31, thereby improving the yield.

Next, modified embodiments in which various modifications are made in the embodiment will be explained below. The same reference numerals will be used for components or parts which have the same structure as those in the embodiment as explained above, and the description of these components or parts will be omitted when deemed appropriate.

The substrate which is to be the drive plate 30 is not limited to those made of a metallic material, and a substrate which is made of a material other than the metallic material can also be used. The method for forming the slits 30*a*, however, is selected as appropriate for a material of which the substrate is made. For example, when the substrate is made of a silicon material, the etching is used; when the substrate is made of a synthetic resin material such as polyimide, a laser-beam processing such as the excimer laser processing or a femtosecond laser beam processing, or the etching is used; when the substrate is made of a glass material, a method such as the etching and microblast processing is used; and when the substrate is made of a ceramics material such as alumina and zirconia, a method such as the microblast processing is used.

First Modified Embodiment

Figure 10:
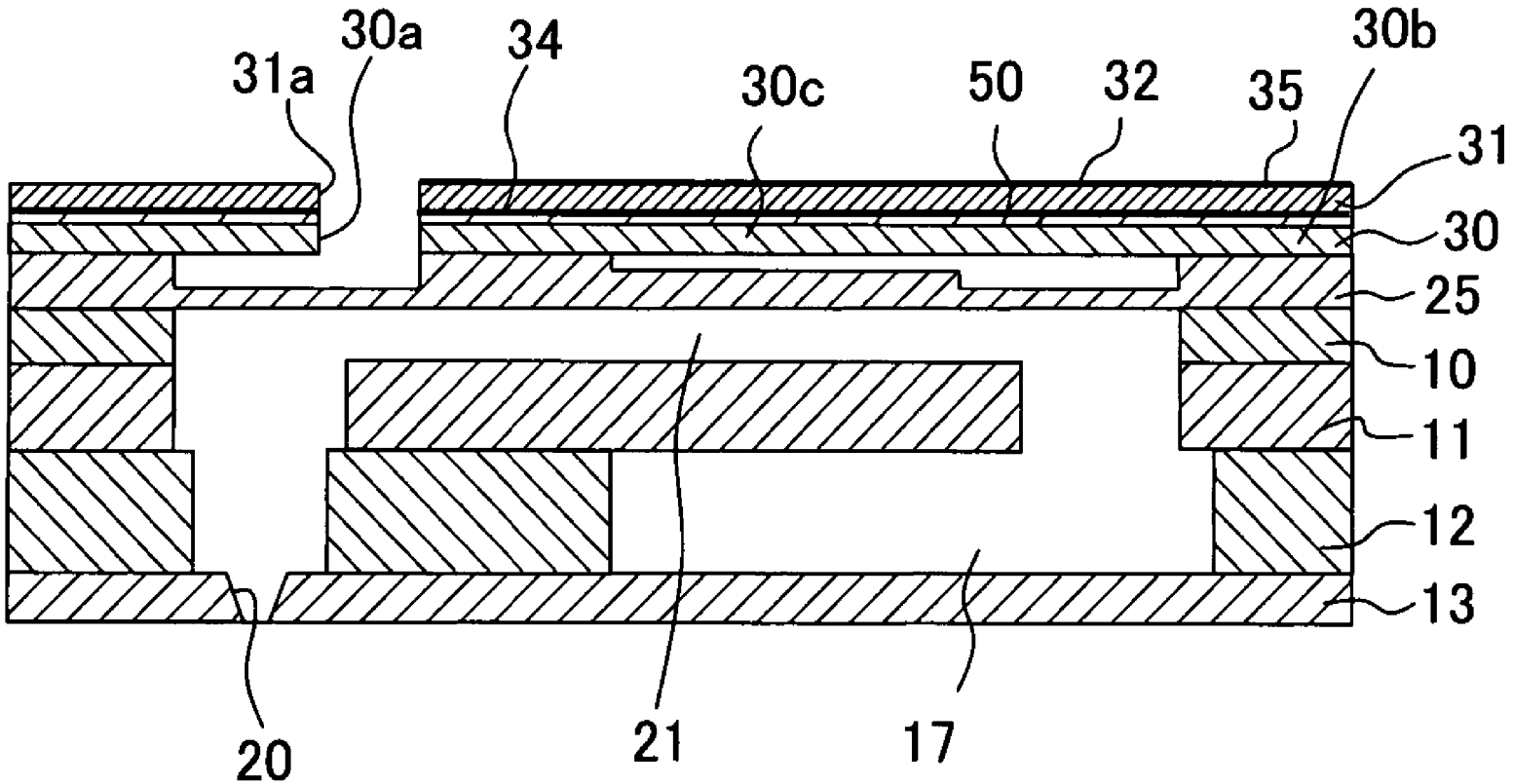
FIG. 10 is a cross-sectional view of a first modified embodiment, corresponding to FIG. 4.

It is not necessarily indispensable that the upper surface of the drive plate 30 also serves as the common electrode (second electrode), and as shown in FIG. 10, a common electrode may be provided separately from the drive plate 30. When the drive plate is a metal plate, as shown in FIG. 10, the upper surface of the drive plate 30 is required to be non-conductive by forming an insulating material layer 50 or the like on the upper surface of the drive plate 30. The insulating material layer 50 can be formed of a ceramics material such as alumina and zirconia, or a synthetic resin material such as polyimide. When the insulating material layer 50 is formed of a ceramics material, a method such as the AD method, the sputtering method, the CVD method, the sol-gel method, a solution coating method, the hydrothermal synthesis method or the like can be used. Further, when the insulating material layer 50 is formed of a synthetic resin material such as polyimide, a method such as the screen printing, a spin coating, and a blade coating can be use. Furthermore, when the drive plate 30 is formed of a silicon material, the upper surface of the drive plate 30 may be made to be non-conductive by performing an oxidation treatment on the upper surface of the drive plate 30. Moreover, when the drive plate 30 is made of an insulating material such as a ceramics material or a synthetic resin material, a common electrode 34 may be formed directly on the upper surface of the drive plate 30.

Second Modified Embodiment

Figure 11:
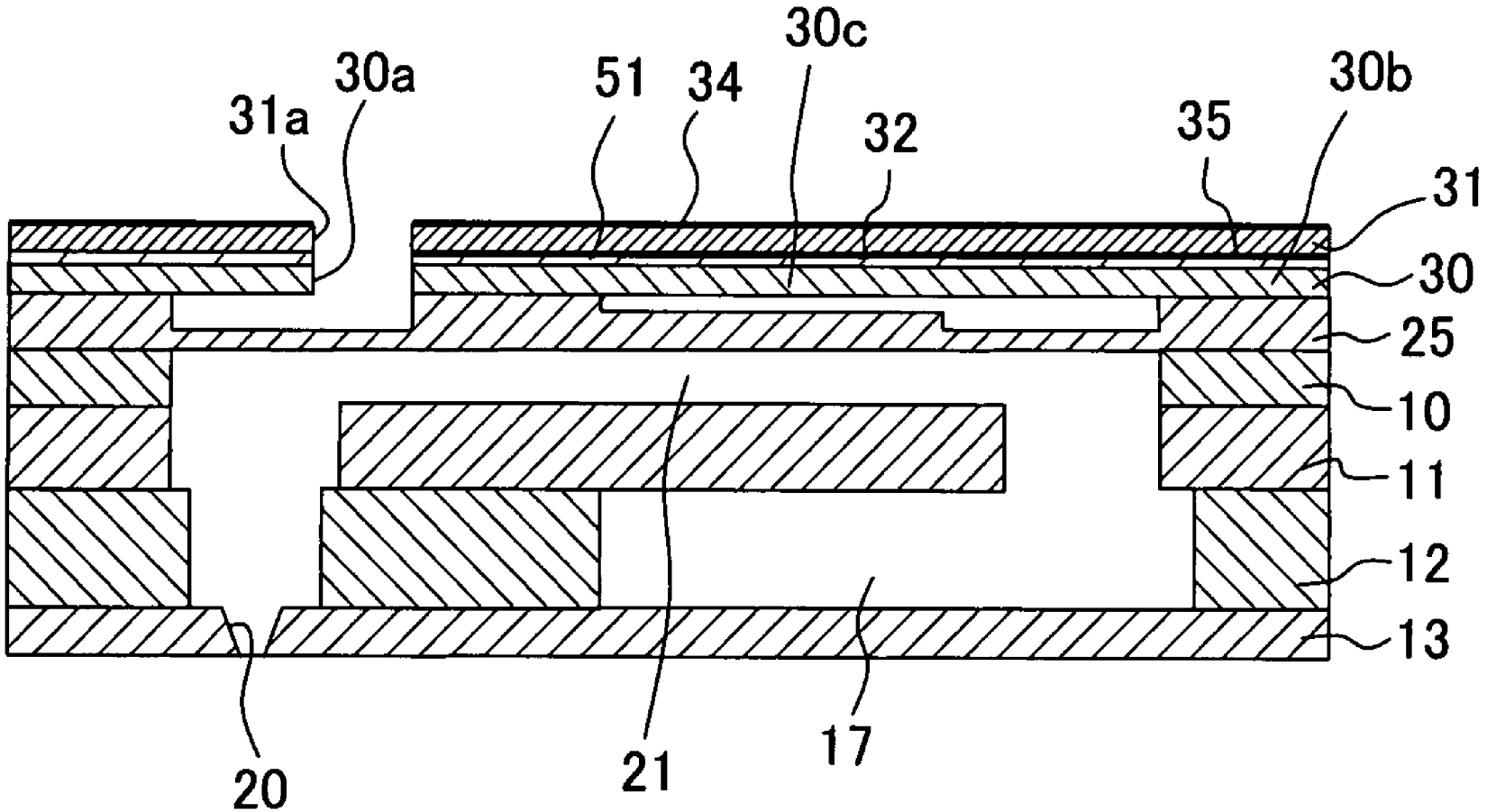
FIG. 11 is a cross-sectional view of a second modified embodiment, corresponding to FIG. 4.

As shown in FIG. 11, the individual electrodes 32 and the wiring portions 35 connected to the individual electrodes 32 respectively may be formed on the upper surface (surface on the side opposite to the pressure chamber 14) of the drive plate 30, and the common electrode may be formed on the upper surface of the piezoelectric layer 31. In this structure, the wiring portions 35 can be drawn in one direction on the upper surface of the drive plate 30. Therefore, a structure of electric connections for applying the drive voltage to the individual electrode 32 becomes comparatively simple. Further, by arranging the driver IC 37 on the upper surface of the drive plate 30, the individual electrode 32 and the driver IC 37 can be connected without using a wiring member such as an FPC. Thus, the structure of electric connections becomes further simple and a reliability of the electric connections is further improved. Similar to the first modified embodiment as described above, when the drive plate 30 is a metal plate, as shown in FIG. 11, the upper surface of the drive plate 30 is required to non-conductive (insulative) by, for example, forming an insulating material layer 51 on the upper surface of the drive plate 30 on which the individual electrodes 32 are to be formed. When the drive plate 30 is made of a silicon material, the upper surface of the drive plate 30 may be made to be non-conductive by performing the oxidation treatment on the upper surface of the drive plate 30. Further, when the drive plate 30 is made of an insulating material such as a ceramics material or a synthetic resin material, the individual electrodes 32 and the wiring portion 35 are formed directly on the upper surface of the drive plate 30.

Third Modified Embodiment

Figure 12:
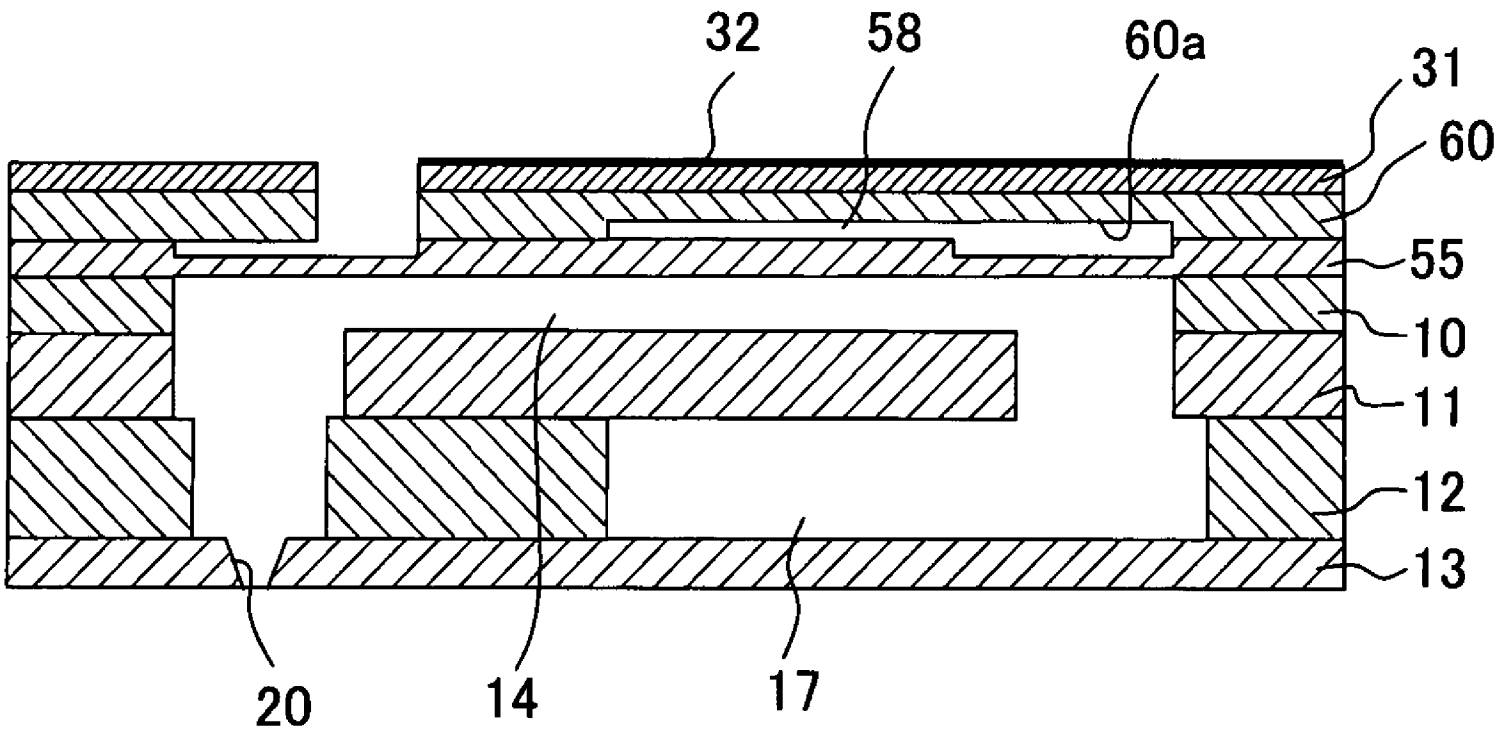
FIG. 12 is a cross-sectional view of a third modified embodiment, corresponding to FIG. 4.

In the embodiment, the flat portions 25*c* having a height smaller to some extent than the joining portions 25*b* is formed in the vibration plate 25, and each of the portions of the drive portions 30*c* which are not fixed to the vibration plate 25 is separated from the vibration plate 25 by a gap (see FIG. 4). However, as shown in FIG. 12, a groove 60*a* may be formed in the lower surface of a drive plate 60 in a portion which is not fixed to a vibration plate 55, and the portion of the drive plate 60 which is not joined to the vibration plate 55 may be separated from the vibration plate 55 with a gap 58 being defined between this portion of the drive plate 60 and the vibration plate 55.

Further, it is not necessarily indispensable that a portion having a height smaller to some extent than a portion joined to the vibration plate or the drive plate (a portion such as the flat portion 25*c* (see FIG. 4) and the groove 60*a* (see FIG. 12)) are formed. For example, by applying an adhesive between the drive portions and the vibration plate only in areas at which the drive portions and the vibration plate are joined, a gap equivalent to a thickness of an adhesive layer between the drive portion and the vibration plate may be formed in each of areas other than the areas at which the drive portions and the vibration plate are joined.

Fourth Modified Embodiment

Figure 6:
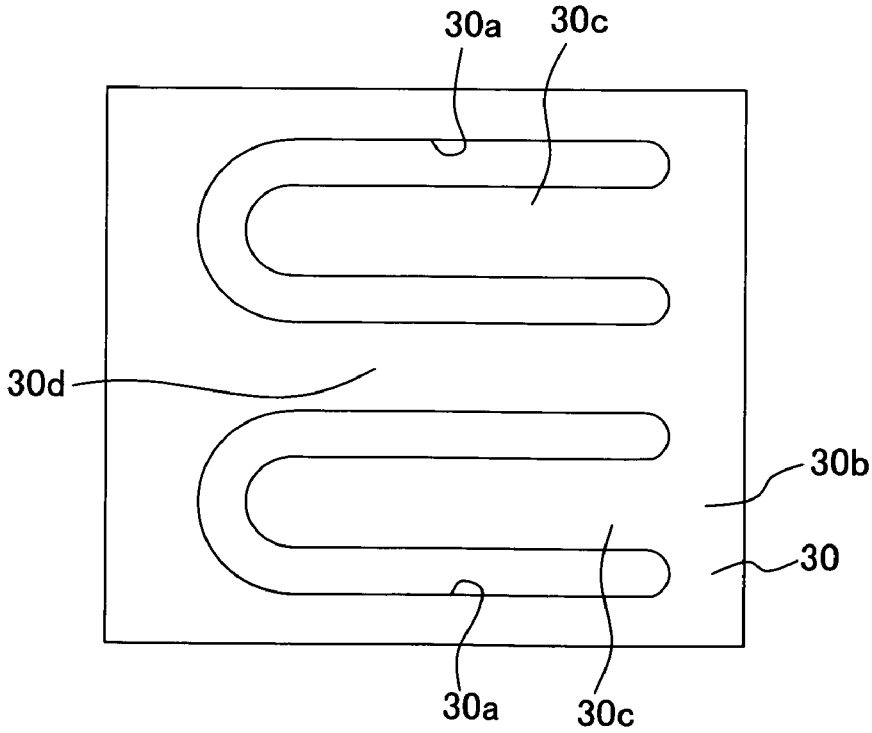
FIG. 6 is a partially enlarged plan view of a drive plate.
Figure 13:
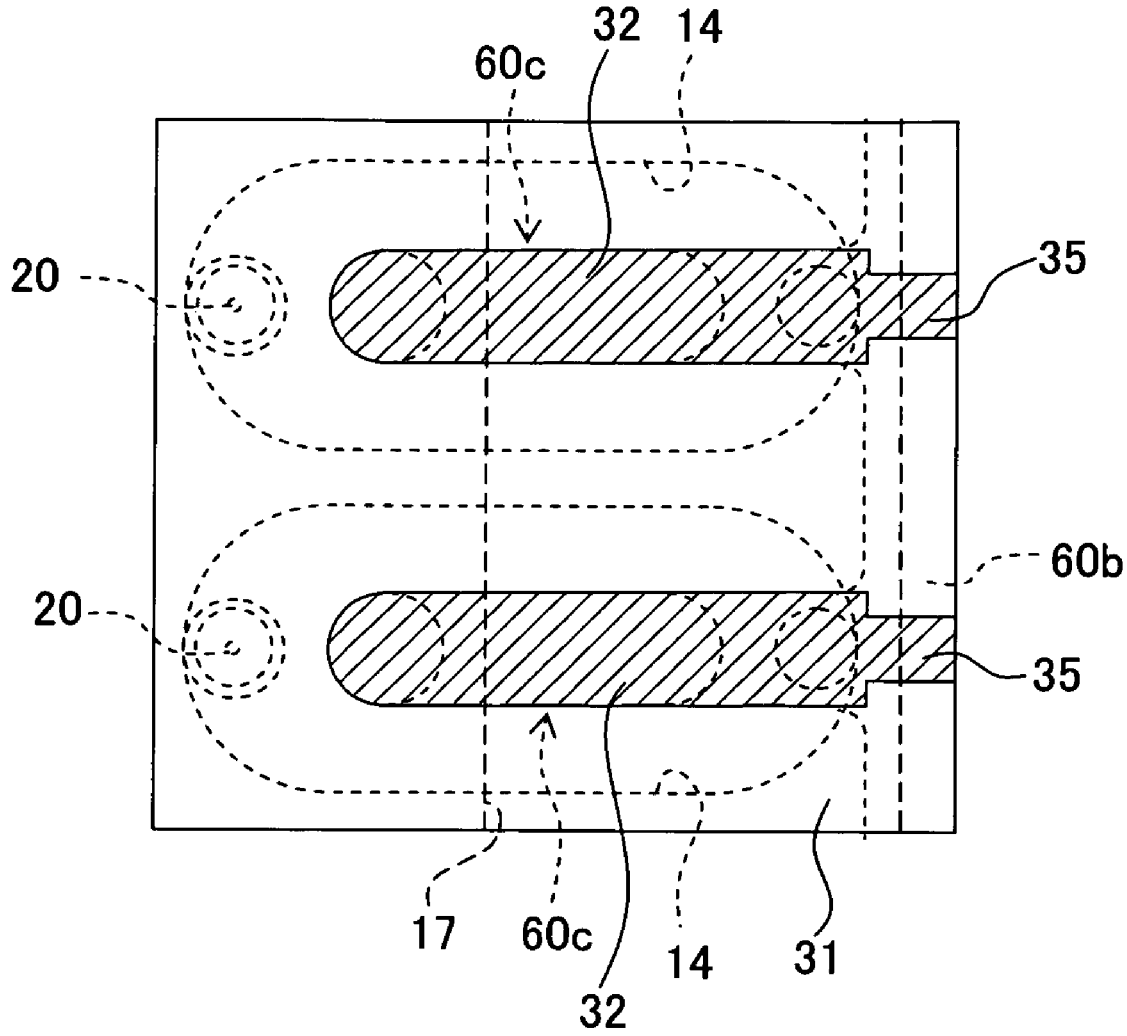
FIG. 13 is a partially enlarged plan view of an ink-jet head of a fourth modified embodiment.
Figure 14:
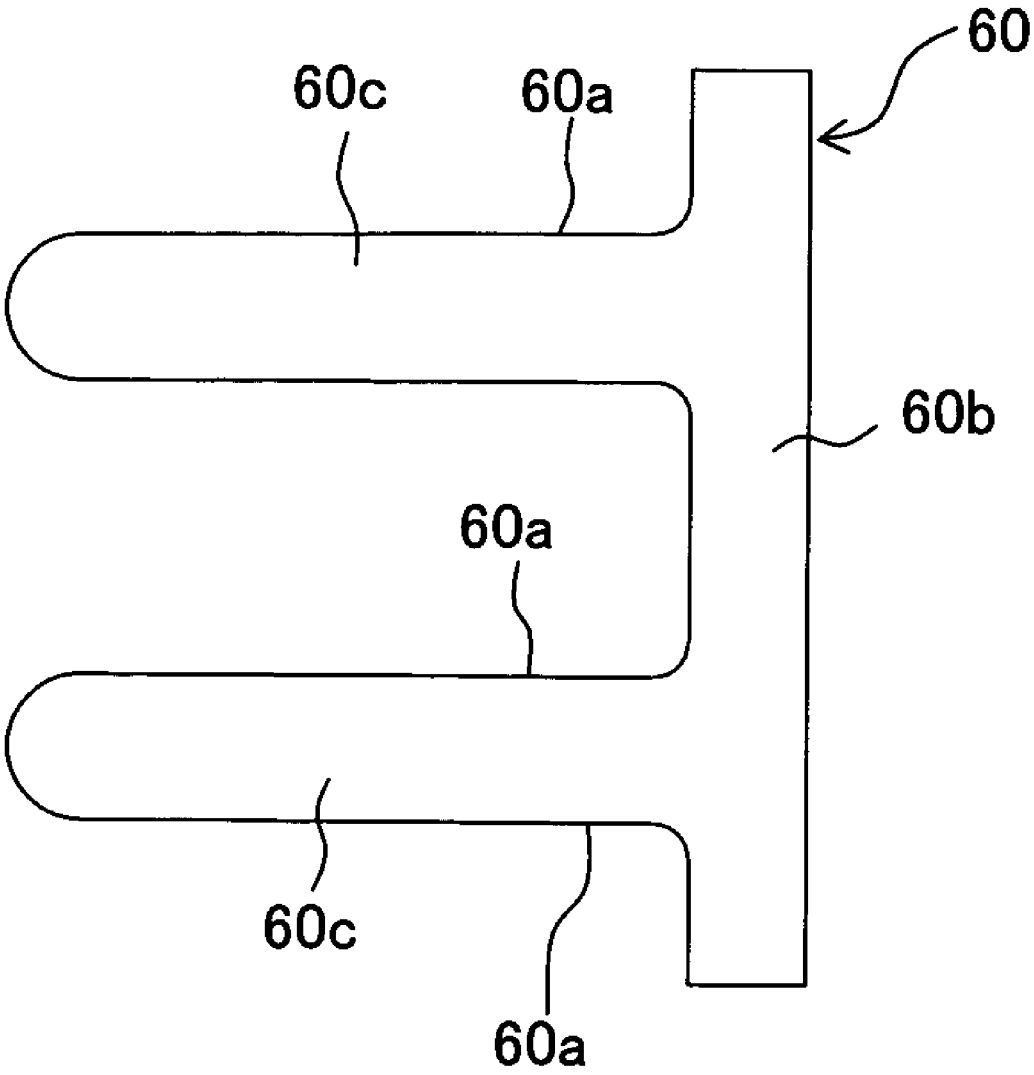
FIG. 14 is a partially enlarged plan view of a drive plate of the fourth modified embodiment.
Figure 15A:
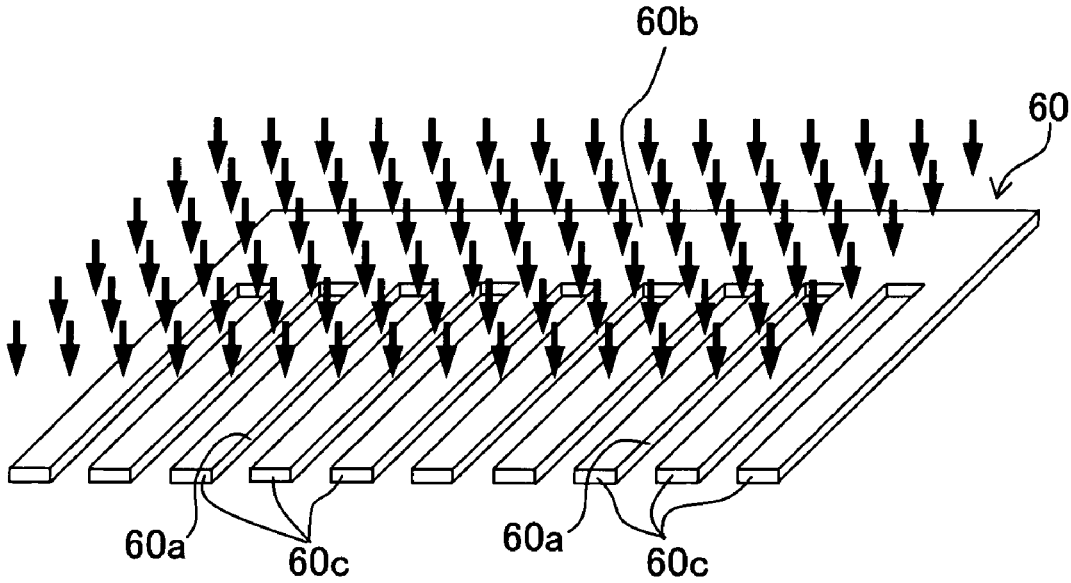
FIG. 15A shows a state in which particles of a piezoelectric material are being deposited on a surface of the drive plate.
Figure 15B:
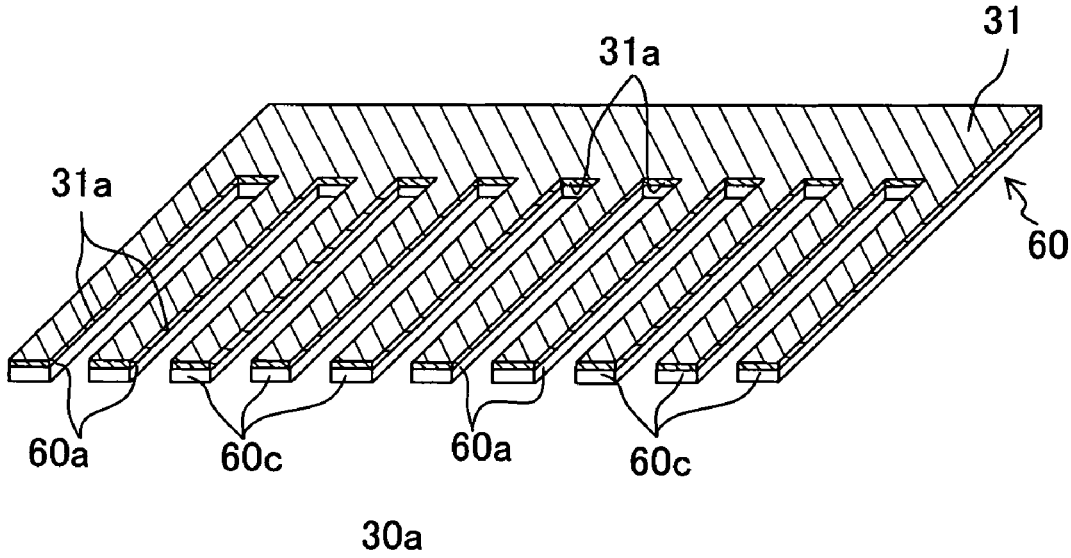
FIG. 15B shows the formed piezoelectric layer.

In the embodiment, the drive plate 30 is structured such that the drive portions 30*c* are isolated (separated) from the surrounding by the slits 30*a* (see FIG. 6). In a fourth modified embodiment, all of portions surrounding drive portions 60*a* may be removed as shown in FIGS. 13 and 14. In other words, the drive plate 60 is constructed only of base portions 60*b* which are provided on the both sides respectively in the longitudinal direction of the drive plate 60, and the drive portions 60*c* each of which extends, from either of the base portions 60*b*, in the longitudinal direction of one of the pressure chambers 14, and which are divided or separated from each other by the slits 60*a*, and the drive plate 60 is formed to be comb-teeth shaped in a plan view. When the piezoelectric layer 31 is formed on one surface of the drive plate 60 of the fourth modified embodiment, as shown in FIG. 15A, firstly the comb-teeth shaped drive plate 60 having the base portions 60*b* and the drive portions 60*c* each extended in one direction from the base portion 60*b* is formed by forming the slits 60*a* in a substrate in the form of a flat plate by a method such as the etching. After forming the drive plate 60, particles of a piezoelectric material are deposited on a surface of the drive plate 60 by a method such as the AD method, the sputtering method, or the CVD method. When the particles of a piezoelectric material are deposited, as shown in FIG. 15B, the piezoelectric layer 31 can be formed on the surface of the drive plate 60 concurrently with the forming, on the piezoelectric layer 31, the slits 31*a* each of which corresponds to one of the slits 60*a* of the drive plate 60.

Fifth Modified Embodiment

Figure 16:
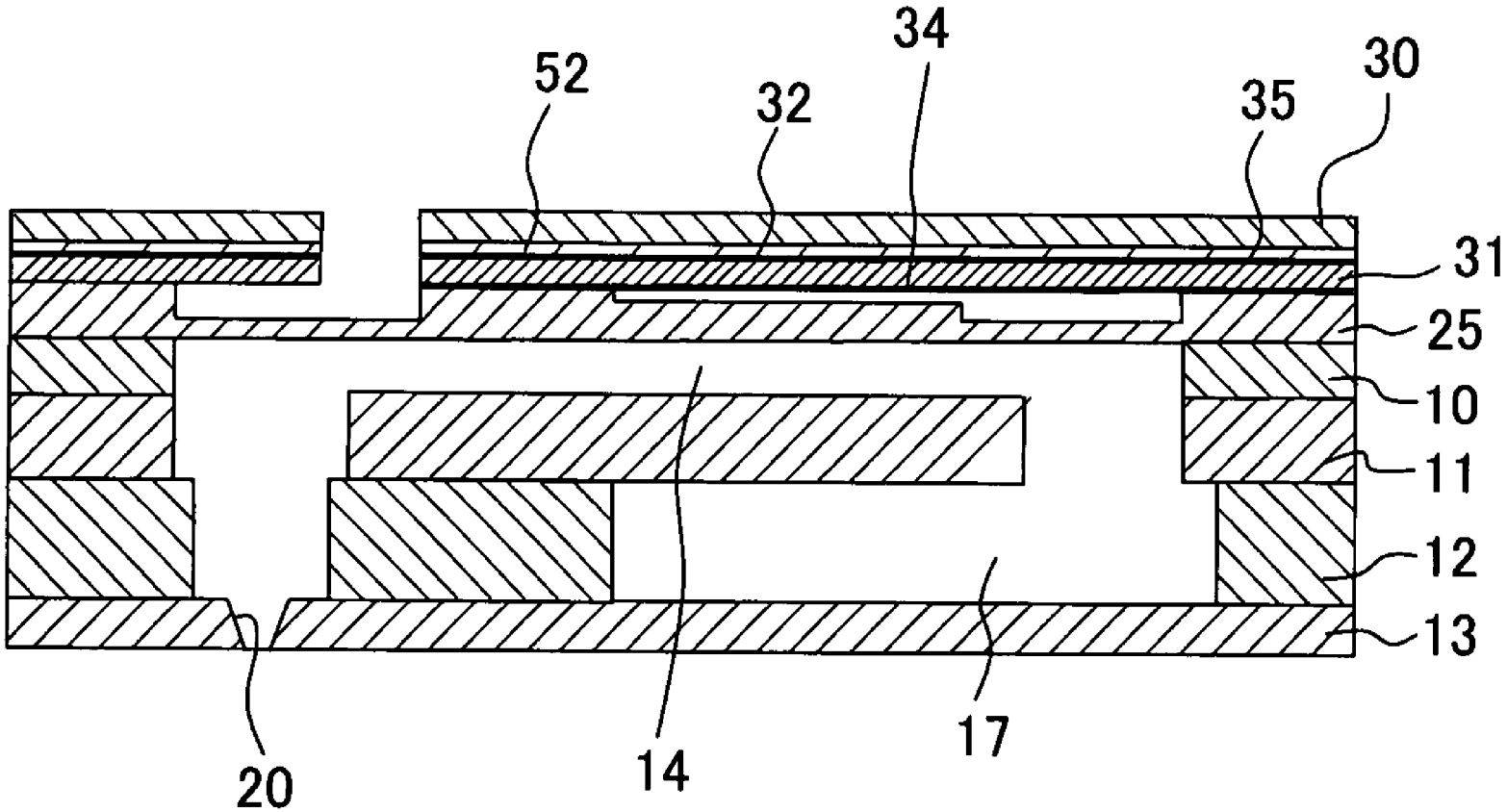
FIG. 16 is a cross-sectional view of a fifth modified embodiment, corresponding to FIG. 4.

In the embodiment explained earlier, the piezoelectric layer 31 is arranged on the upper surface (surface on the side opposite to the pressure chamber 14) of the drive plate 30 (see FIG. 4). The piezoelectric layer 31 may be arranged on a lower surface (surface on a side of the pressure chamber 14) of the drive plate 30 as shown in FIG. 16. In FIG. 16, although the individual electrodes 32 (and the wiring portions 35) are formed on the upper surface of the piezoelectric layer 31, and the common electrode 34 is formed on the lower surface (surface on a side of the vibration plate 25) of the piezoelectric layer 31, the individual electrodes 32 and the common electrode 34 may be arranged at vertically reversed positions from that of FIG. 16. The piezoelectric layer 31 on the lower side of the drive plate 30 is joined to the upper surface of the vibration plate 25 via the common electrode 34 (or the individual electrodes 32). When the drive plate 30 is a metal plate, as shown in FIG. 16, the lower surface of the drive plate 30 on which the individual electrodes 32 (or the common electrode 34) are to be formed is required to be non-conductive by forming an insulating material layer 52 or the like on the lower surface of the drive plate 30. When the drive plate 30 is made of a silicon material, the lower surface may be made to be non-conductive by performing the oxidation treatment on the lower surface of the drive plate 30. Further, when the drive plate 30 is made of an insulating material such as a ceramics material or a synthetic resin material, the individual electrodes 32 (or the common electrode 34) are formed directly on the lower surface of the drive plate 30.

Sixth Modified Embodiment

Figure 17:
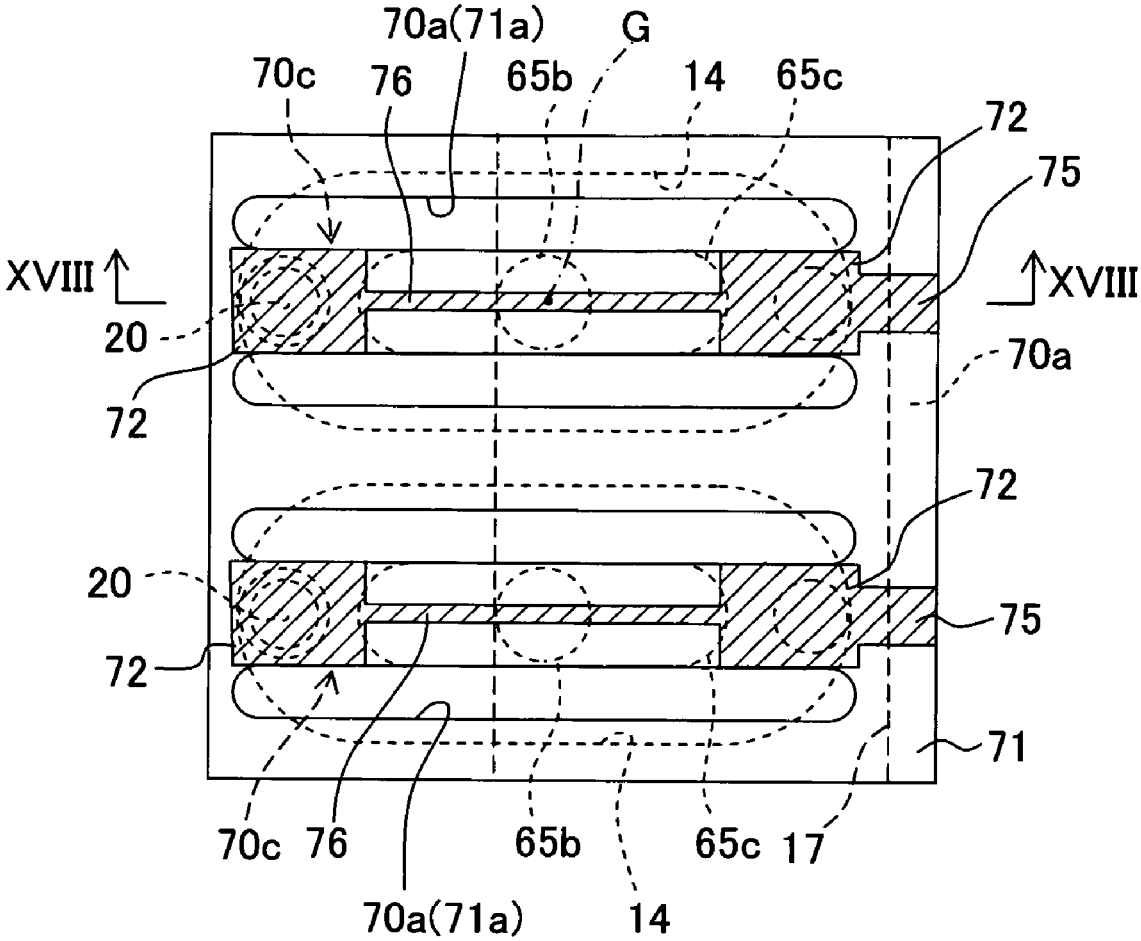
FIG. 17 is a partially enlarged view of an ink-jet head of a sixth modified embodiment.
Figure 18:
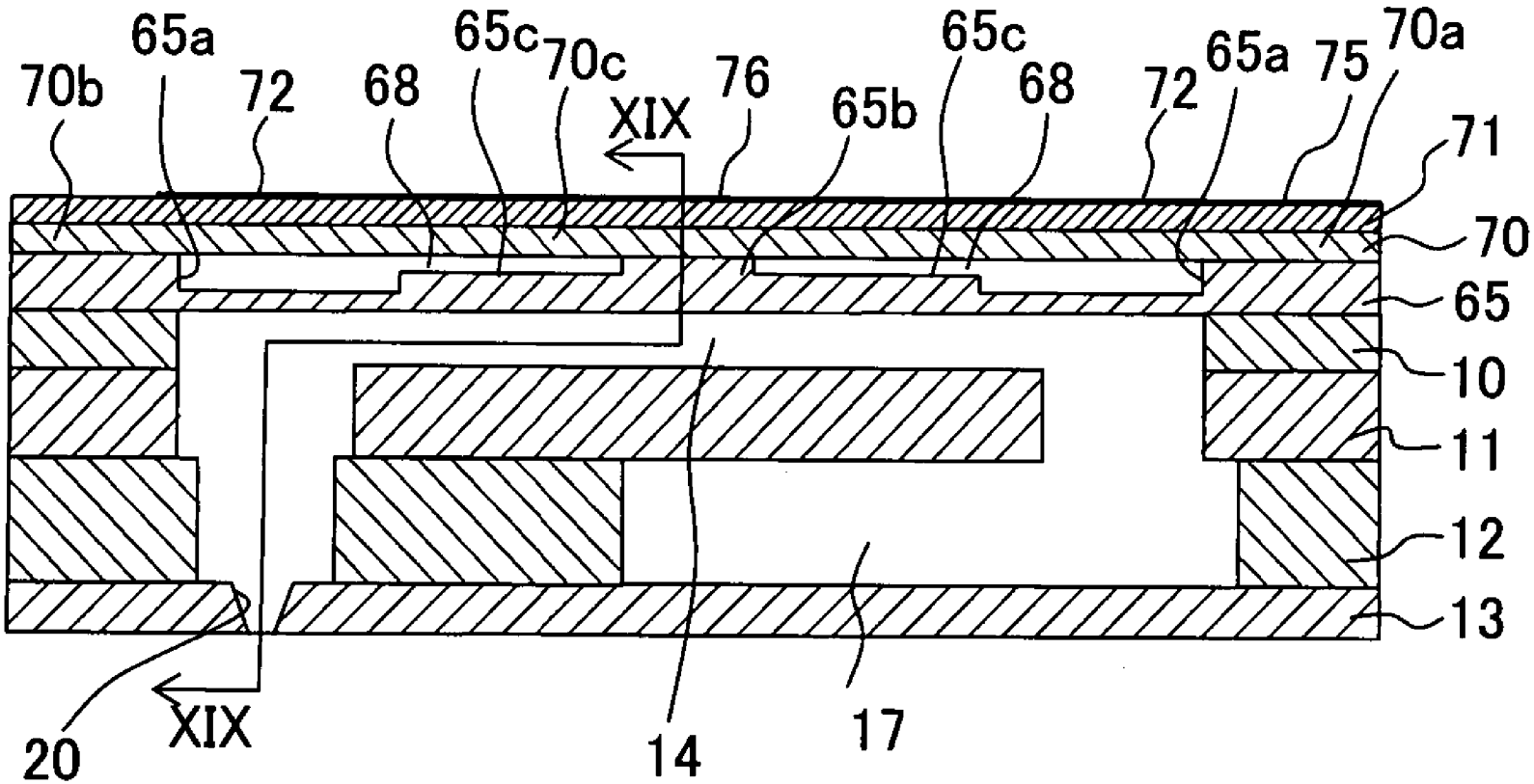
FIG. 18 is a cross-sectional view taken along a line XVIIIC-XVIIIC shown in FIG. 17.
Figure 19:
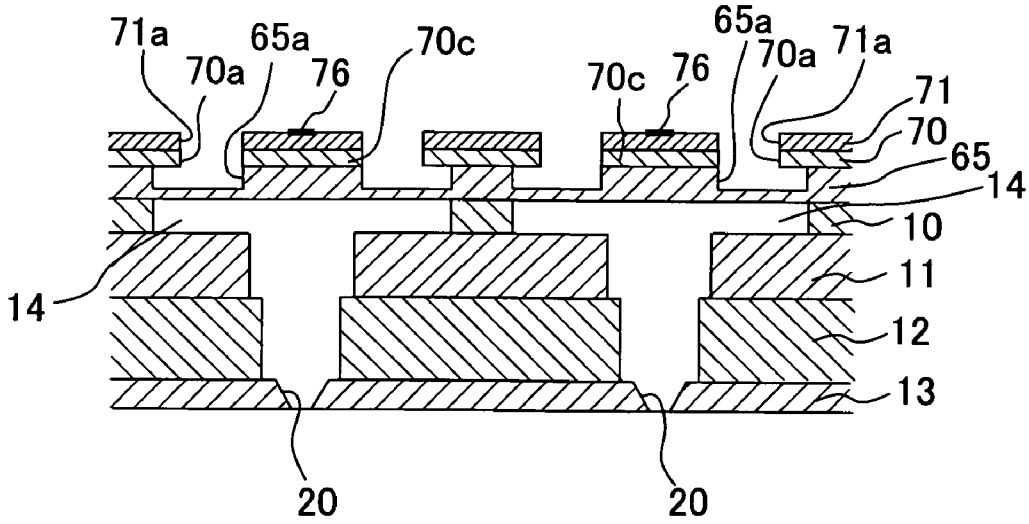
FIG. 19 is a cross-sectional view taken along a line XIXD-XIXD shown in FIG. 18.

As shown in FIG. 17 to FIG. 19, drive portions 70*c* may extend from one end portions of the pressure chambers 14 in the longitudinal direction to the other end portions of the pressure chambers 14 in the longitudinal direction respectively, such that the drive portions 70*c* straddles over the pressure chambers 14, and may be fixed to a vibration plate 65 at portions each of which faces the substantially central portion of one of the pressure chambers 14. As shown in FIG. 17, each of the drive portions 70*c* is isolated (separated) by two slits 70*a* extending in the longitudinal direction of one of the pressure chambers 14 from the surrounding, except for a connecting portion with one of base portions 70*b* disposed on both ends in the longitudinal direction of the drive plate 70. Each of the drive portions 70*c* is supported, from both sides of one of the pressure chambers 14 in the longitudinal direction, by the base portions 70*b* disposed on both end sides of the drive portion 70*c*, and is connected to a joining portion 65*b* of the vibration plate 65 at a midway portion facing the substantially central portion of one of the pressure chambers 14. Similarly as in the embodiment explained earlier, an annular groove 65*a* is formed in an area of the vibration plate 65 overlapping with the peripheral portion of each of the pressure chambers 14. Further, the joining portion 65*b* of the vibration plate 65 is provided in an area overlapping with the center of gravity G (see FIG. 17) of each of the pressure chambers 14. On both sides of the joining portion 65*b* (both of left and right sides in FIG. 18), two flat portions 65*c* in each of which a height of its upper surface is smaller than a height of the joining portion 65*b* and is greater than a height (depth) of the annular groove 65*a* are provided. In other words, a portion of each of the drive portions 70*c*, which is not joined to the joining portion 65*b* (portion which is not fixed to the vibration plate 65), is separated from the vibration plate 65 with a gap 68 being defined with respect to the vibration plate 65 (flat portion 65*c*).

A piezoelectric layer 71 is formed on the upper surface of a vibration plate 70. Slits 71*a* having a similar plane shape as that of the slits 70*a* of the drive plate 70, are formed in the piezoelectric layer 71 corresponding to the slits 70*a* respectively. Furthermore, individual electrodes 72 are formed on the piezoelectric layer 71 in areas each of which faces one of the drive portions 70*c*. As shown in FIG. 17, each of the individual electrodes 72 are formed as two individual electrodes on the surface of the piezoelectric layer 71 in an area overlapping with both end portions of one of the drive portions 70*c* (area except for the portion in which the drive plate 70 is fixed to the vibration plate 65), this area being included in the area on the upper surface of the piezoelectric layer 71 facing each of the pressure chambers 14. A wiring portion 75 for supplying the drive voltage is connected to one of the two individual electrodes 72 (right side in FIG. 17), and the two individual electrodes 72 are connected mutually by a wiring portion 76 extending between the two individual electrodes 72 in the longitudinal direction of each of the pressure chambers 14.

When the drive voltage is applied to the two individual electrodes 72 via the wiring portions 75 and 76, if a direction in which the piezoelectric layer 71 is polarized and a direction of the electric field are same, portions of the piezoelectric layer 71, each of which is arranged on the upper surface of the both end portions of one of the drive portions 70*c* are contracted in the horizontal direction. As the portions of the piezoelectric layer 71 are contracted, both end portions of the drive portion 70*c* are bent to curve upward, and a portion of the drive plate 70 between the both end portions and is joined to the joining portion 65*b* of the vibration plate 65 is displaced upward. At this time, the joining portion 65*b* of the vibration plate 65 is raised upward by the drive portion 70*c*, thereby increasing the volume of the pressure chamber 14 associated with the drive portion 70*c*. Therefore, it is possible to realize a so-called "pulling ejection" in which the volume of the pressure chamber 14 is increased once by applying the drive voltage to the individual electrode 72, and then the volume of the pressure chamber 14 is decreased (returned to its original volume) by stopping the application of drive voltage to the individual electrode 72, thereby applying pressure to the ink in the pressure chamber 14.

Seventh Modified Embodiment

Figure 20:
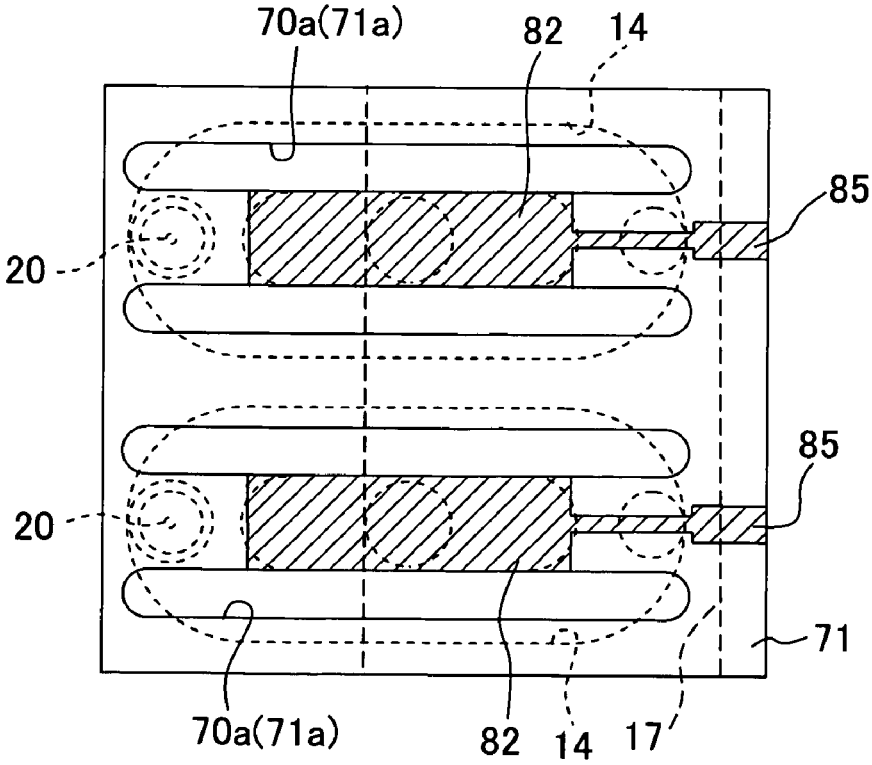
FIG. 20 is a partially enlarged view of an ink-jet head according to a seventh modified embodiment.

By changing the arrangement of individual electrodes on the upper surface of the piezoelectric layer 71, the piezoelectric actuator can be structured such that the piezoelectric actuator is capable of performing a so-called "pushing ejection" in which the volume of the pressure chamber 14 is decreased when the drive voltage is applied, thereby applying pressure to the ink in the pressure chamber. For example, as shown in FIG. 20, individual electrodes 82 may be formed on the upper surface of the piezoelectric layer 71 in areas each of which faces the substantially central portion of one of the pressure chambers 14 (areas each including the portion in which the drive plate 70 is fixed to the vibration plate 65). In this case, when the drive voltage is applied to an individual electrode 82 of the individual electrodes 82 via a wiring portion 85, if the direction in which the piezoelectric layer 71 is polarized is same as the direction of the electric field, a portion of the piezoelectric layer 71 arranged on the upper surface of the drive portion 70*c* at a midway portion of the drive portion 70*c* is contracted in the horizontal direction. At this time, the drive portion 70*c* is bent to project downward, thereby making the midway portion of the drive portion 70*c* press the vibration plate 65 downward. Therefore, the volume of the pressure chamber 14 is decreased, and pressure is applied to the ink in the pressure chamber 14.

Eighth Modified Embodiment

Figure 21:
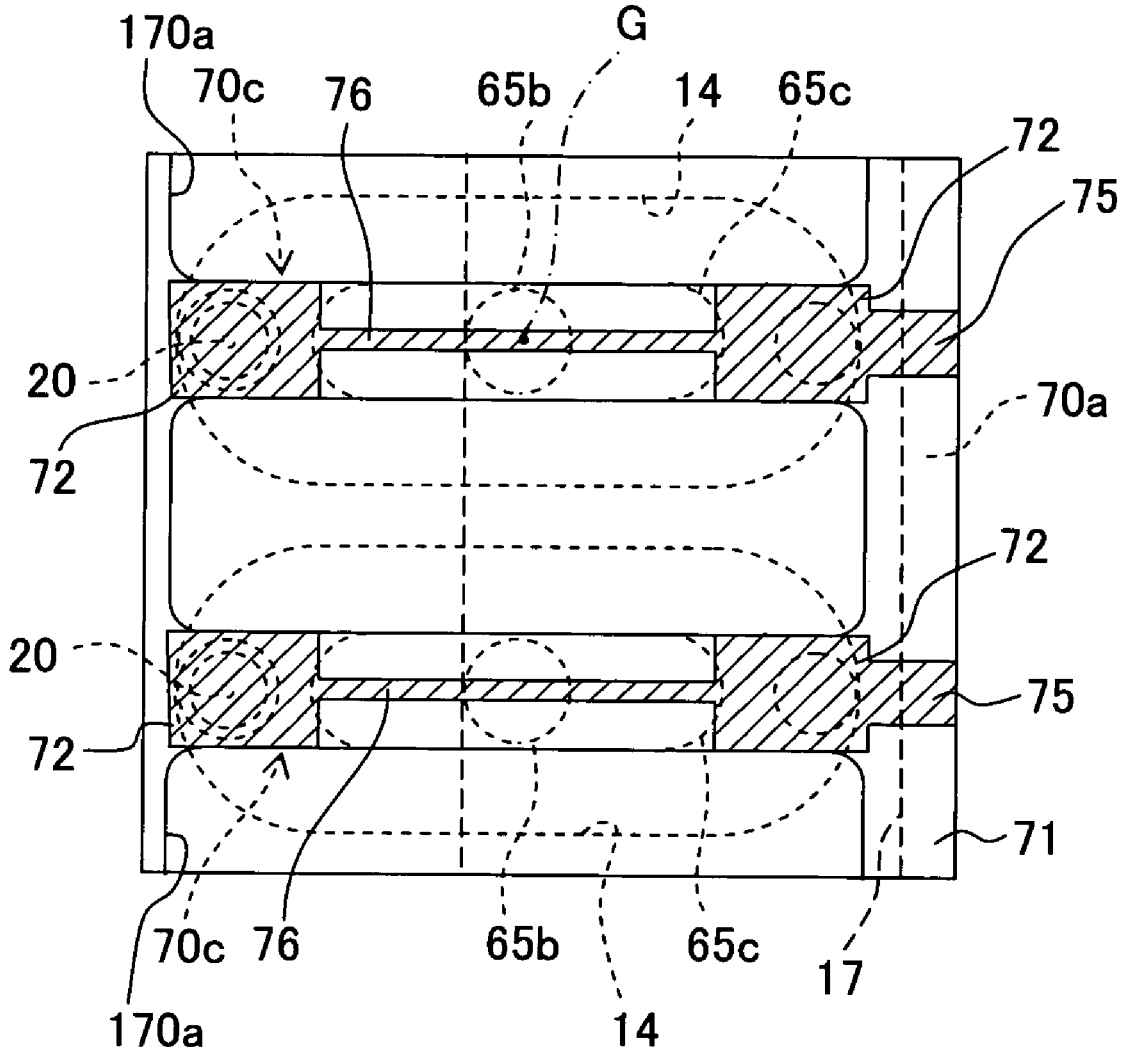
FIG. 21 is a partially enlarged view of an ink-jet head according to an eighth modified embodiment.

A piezoelectric actuator for the liquid transporting apparatus of an eighth modified embodiment is same as the piezoelectric actuator of the sixth modified embodiment except for the shape of through-grooves formed in the drive plate. As shown in FIG. 21, since through grooves 170*a* of the piezoelectric actuator of the eighth modified embodiment are formed entirely over areas between adjacent drive portions 70*c*, cross-talk between the adjacent drive portions 70*c* can be further decreased. The shape of individual electrodes formed on the upper surface of the drive plate can be made to be same as the shape of the individual electrodes in the seventh modified embodiment. In this case, the pressure can be applied to the pressure chamber by the so-called pushing ejection.

Ninth Modified Embodiment

In the embodiment and the modified embodiments as explained above, each of the drive portions of the drive plate is fixed to the vibration plate only at both ends in the longitudinal direction of the drive portion. Therefore, the drive portions of the drive plate and the vibration plate were arranged to be separated except for at the both ends of each of the drive portions. On the other hand, in a ninth modified embodiment, the drive portions of the drive plate and the vibration plate are arranged such that the drive portions of the drive plate and the vibration plate are tightly adhered entirely in the longitudinal direction of the drive portions.

Figure 22A:
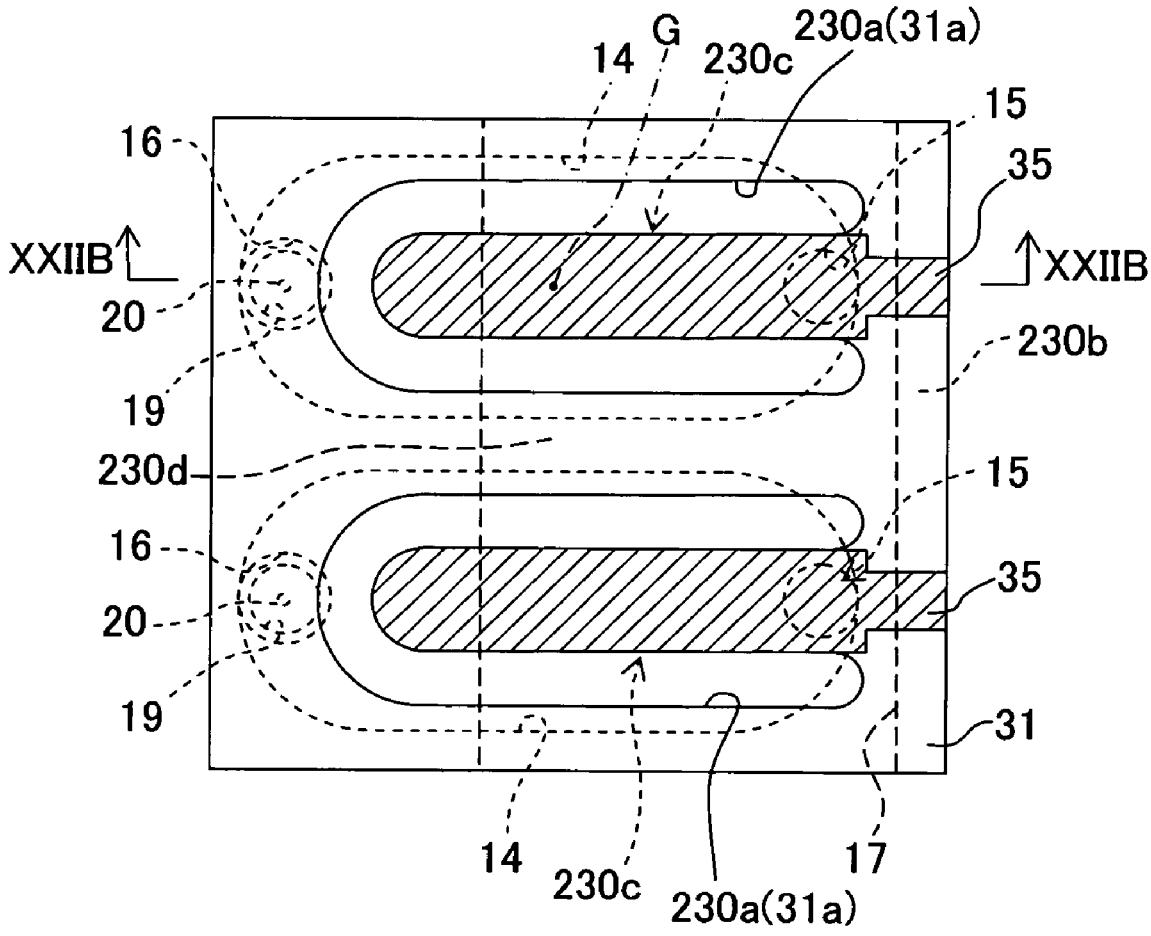
FIG. 22A is a partially enlarged view of an ink-jet head according to a ninth modified embodiment.
Figure 22B:
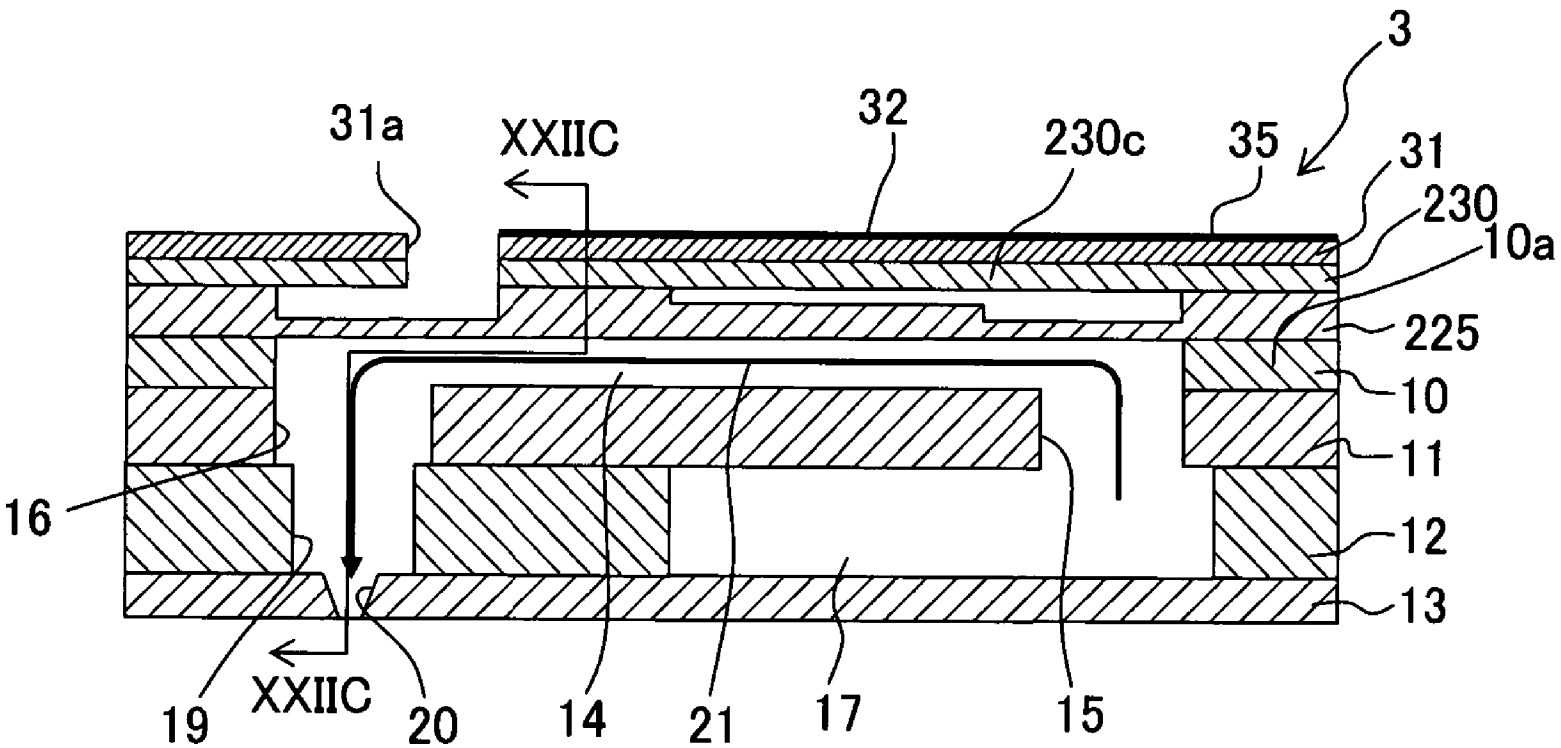
FIG. 22B is a cross-sectional view taken along a line XXIIB-XXIIB shown in FIG. 22A.
Figure 22C:
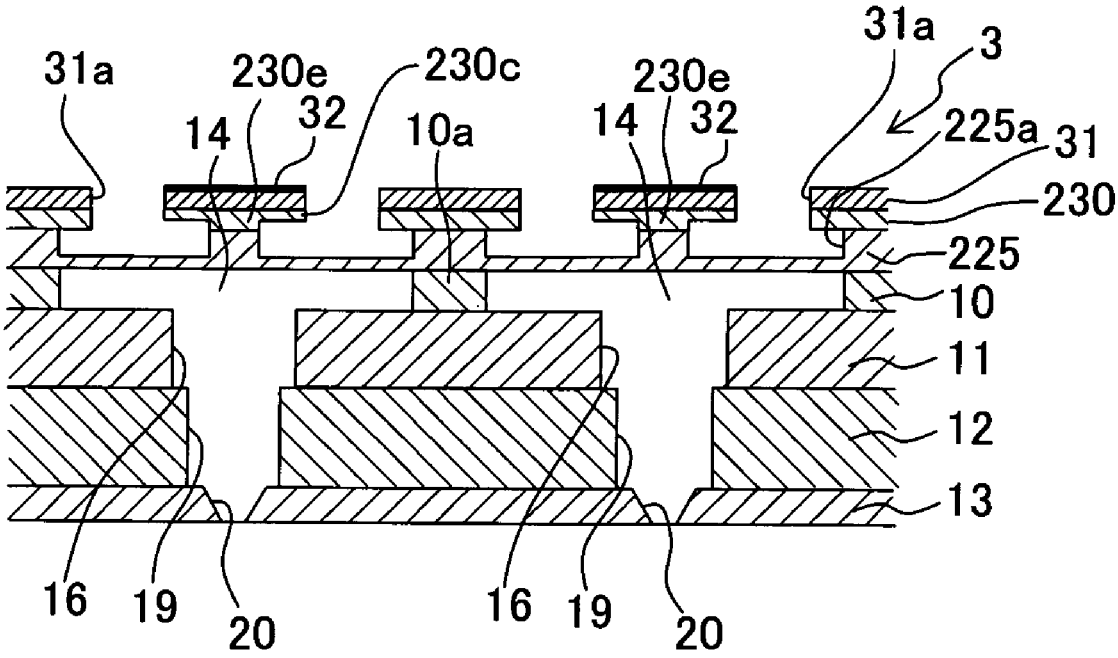
FIG. 22C is a cross-sectional view taken along a line XXIIC-XXIIC shown in FIG. 22B.

A piezoelectric actuator of the ninth modified embodiment has a structure same as the structure of the piezoelectric actuator of the embodiment except for a cross-sectional shape of the drive portions of the drive plate and a shape of the vibration plate (FIG. 22A to FIG. 22C). As shown in FIG. 22B, on surfaces of drive portions 230*c* of a drive plate 230, the surface being on a side of pressure chambers 14, a projection 230*e* extending along the longitudinal direction of each of the drive portions 230*c* is formed in the central portion in the short direction of each of the drive portions 230*c*. A surface of each of the drive portions 230*c* on a side opposite to the pressure chamber 14 is formed to be flat, and the piezoelectric layer 71 is formed on this surface. On a surface of a vibration plate 225 on a side opposite to the pressure chambers 14, recesses 225*a* each of which substantially overlaps in a plan view with one of the pressure chambers 14 are formed except for portions of the drive portions 230*c* facing the projections 230*e* respectively. In other words, in a portion of the vibration plate 225 overlapping in a plan view with each of the pressure chambers 14, the plate thickness of a portion of the vibration plate 225 which faces the projection 230*e* of one of the drive portion 230*c* is greater than the plate thickness of the remaining portion of the vibration plate 225. The drive portions 230*c* of the drive plate 230 are adhered to the vibration plate 225 at the projections 270*e* respectively.

In order to drive a drive portion 230*c* of the drive portions 230*c*, when the voltage is applied to an individual electrode 32 corresponding to the driving portion 230*c*, a portion of the piezoelectric layer 31 facing the individual electrode 32 to which the voltage is applied is contracted in a horizontal direction of the piezoelectric layer. Since the drive portion 230*c* of the drive plate 230 is adhered to the vibration plate 225 along the longitudinal direction of the drive portion 230*c*, a deformation in which the piezoelectric layer 31 is contracted in the longitudinal direction of the drive portion 230*c* can be propagated effectively to the vibration plate 225. Further, since both end portions of the drive portion 230*c* in the short direction are not constrained by the vibration plate 225, the deformation in which the piezoelectric layer 31 is contracted in the longitudinal direction of the drive portion 230*c* is not hindered. The shape of the surface of vibration plate 225 facing the drive portions 230*c* may be formed to have an arbitrary shape such as a flat shape, provided that this surface of the vibration plate 225 facing the drive portions 230*c* has a shape which is not tightly adhered with a portion of the drive portion 230*c* other than at the projections 230*e*.

The embodiment and the modified embodiments in each of which the present invention is applied to the ink-jet head have been explained above. However, an embodiment to which the present invention is applicable is not limited to the embodiment and the modified embodiments. For example, the present invention can also be applied to a liquid transporting apparatus which transports liquids other than ink. Further, in each of the embodiment and its modified embodiments, the method of producing was described as a method of producing the piezoelectric actuator. However, the method, as it is, can be used as a method of producing the liquid transporting apparatus of the present invention.

What is claimed is:

1. A liquid transporting apparatus comprising:

a channel unit in which a liquid channel including a pressure chamber which is long in one direction is formed; and a piezoelectric actuator which applies pressure to a liquid in the pressure chamber by changing a volume of the pressure chamber, wherein:

the channel unit includes a vibration plate which covers the pressure chamber; and the piezoelectric actuator includes:

a drive plate which has a base portion which is arranged, on a side of the vibration plate opposite to the pressure chamber, outside of an end portion in a longitudinal direction of the pressure chamber; and a drive portion which extends from the base portion along the longitudinal direction at least up to an area facing a substantially central portion of the pressure chamber, the drive plate being fixed to the vibration plate at the base portion and at a portion of the drive portion facing the substantially central portion of the pressure chamber;

a piezoelectric layer arranged along a plane direction of the drive plate;

a first electrode which is arranged at an area on one surface side of the piezoelectric layer, the area facing the pressure chamber; and a second electrode which is arranged on the other surface side of the piezoelectric layer, wherein:

openings are formed in the drive plate, on both sides respectively of the drive portion, the both sides being in a short direction orthogonal to the longitudinal direction of the drive portion, each of the openings extending from the base portion along the longitudinal direction at least up to the area facing the substantially central portion of the pressure chamber, and the both sides of the drive portion in the short direction are defined by the openings; and the drive portion of the drive plate is separated from the vibration plate at a portion of the vibration plate overlapping in a plan view with the pressure chamber.

2. The liquid transporting apparatus according to claim 1, wherein the piezoelectric layer is arranged on the drive plate on the side opposite to the pressure chamber.

3. The liquid transporting apparatus according to claim 2, wherein the first electrode and a wiring portion connected to the first electrode are formed on a surface of the piezoelectric layer on a side opposite to the pressure chamber.

4. The liquid transporting apparatus according to claim 2, wherein the first electrode and a wiring portion connected to the first electrode are formed on the surface of the drive plate on the side opposite to the pressure chamber.

5. The liquid transporting apparatus according to claim 1, wherein a plate thickness of a portion of the vibration plate facing the substantially central portion of the pressure chamber is greater than a plate thickness of a portion of the vibration plate facing a peripheral portion of the pressure chamber.

6. The liquid transporting apparatus according to claim 1, wherein the drive portion extends up to the area facing the substantially central portion of the pressure chamber, and the drive portion is fixed to the vibration plate at a tip end portion of the drive portion.

7. The liquid transporting apparatus according to claim 6, wherein the drive portion extends from one end side in the longitudinal direction of the pressure chamber up to other end side in the longitudinal direction of the pressure chamber, the other end side being disposed farther from a center of gravity of the pressure chamber.

8. The liquid transporting apparatus according to claim 1, wherein the drive portion extends from one end portion in the longitudinal direction of the pressure chamber to other end portion in the longitudinal direction of the pressure chamber, so as to straddle over the pressure chamber; and the drive portion is fixed to the vibration plate at a portion facing the substantially central portion of the pressure chamber.

9. The liquid transporting apparatus according to claim 8, wherein the first electrode is formed only in an area on one surface side of the piezoelectric layer, the area facing the pressure chamber, the area being other than another area on the one surface side corresponding to the portion of the drive plate which is fixed to the vibration plate.

10. The liquid transporting apparatus according to claim 8, wherein the first electrode is formed in an area on one surface side of the piezoelectric layer, the area facing the pressure chamber, the area including another area on the one surface side corresponding to the portion of the drive plate which is fixed to the vibration plate.

11. The liquid transporting apparatus according to claim 1, wherein the both sides in the short direction of the drive portion are not fixed to the vibration plate.

12. The liquid transporting apparatus according to claim 1, wherein the piezoelectric actuator has areas in which the piezoelectric layer is not formed, the areas corresponding to the openings respectively.

13. The liquid transporting apparatus according to claim 1, wherein the pressure chamber has a plurality of chambers which are long in one direction; and the piezoelectric actuator is formed as a plurality of piezoelectric actuators which are provided, corresponding to the chambers respectively, at portions on the surface of the vibration plate on the side opposite to the chambers, the portion substantially overlapping in a plan view with the chambers respectively.

14. The liquid transporting apparatus according to claim 13, wherein a drive portion of a piezoelectric actuator included in the piezoelectric actuators and corresponding to one of two chambers included in the chambers, and a drive portion of another piezoelectric actuator corresponding to the other of the two chambers are separated by the openings, the two chambers being adjacent to each other in the short direction which is orthogonal to the longitudinal direction of the chambers.

15. The liquid transporting apparatus according to claim 1, wherein a portion of the drive portion not fixed to the vibration plate is separated from the vibration plate while defining a gap between the portion and the vibration plate.

16. A method of producing a liquid transporting apparatus including a piezoelectric actuator which is arranged on one surface of a vibration plate of a channel unit in which a liquid channel including a plurality of pressure chambers is formed, the vibration plate covering pressure chambers, and which applies pressure to a liquid in the pressure chambers, the method comprising:

a step of providing a drive plate substrate which forms a drive plate;

a drive plate forming step of forming, in the drive plate substrate, a base portion which is located in an area outside of the pressure chambers when the drive plate substrate is arranged on the one surface of the vibration plate; a plurality of drive portions each of which extends from the base portion to an area facing one of the pressure chambers when the drive plate substrate is arranged on the one surface of the vibration plate; and openings each of which separates a drive portion included in the drive portions from another drive portion adjacent to the drive portion, the openings being formed on both sides of each of the drive portions, the both sides being in a direction orthogonal to a direction in which the drive portions extend; and a piezoelectric layer forming step of forming a piezoelectric layer by depositing particles of a piezoelectric material on one surface of the drive plate substrate.

17. The method of producing liquid transporting apparatus according to claim 16, wherein in the piezoelectric layer forming step, the piezoelectric layer is formed by an aerosol deposition method, a sputtering method, or a chemical vapor deposition method.

* * * * *